US012221752B2

(12) United States Patent
Stoller

(10) Patent No.: US 12,221,752 B2
(45) Date of Patent: Feb. 11, 2025

(54) SELF-STANDING MODULAR STRUCTURE AND SUPPORT THEREOF

(71) Applicant: James E Stoller, Genoa City, WI (US)

(72) Inventor: James E Stoller, Genoa City, WI (US)

( * ) Notice: Subject to any disclaimer, the term of this patent is extended or adjusted under 35 U.S.C. 154(b) by 370 days.

(21) Appl. No.: 17/653,387

(22) Filed: Mar. 3, 2022

(65) Prior Publication Data

US 2022/0282432 A1 Sep. 8, 2022

Related U.S. Application Data

(60) Provisional application No. 63/200,385, filed on Mar. 3, 2021.

(51) Int. Cl.

| | |
|---|---|
| ***A63C 19/10*** | (2006.01) |
| ***E01C 13/10*** | (2006.01) |
| ***E01C 13/12*** | (2006.01) |

(52) U.S. Cl.

CPC ..... *E01C 13/102* (2013.01); *A63C 19/10* (2013.01); *E01C 13/12* (2013.01)

(58) Field of Classification Search

CPC ... A63C 19/00; A63C 19/10; A63C 2019/085; A63C 2203/10; E01C 13/02; E01C 13/12

USPC ..... 472/90, 92, 94

See application file for complete search history.

(56) References Cited

U.S. PATENT DOCUMENTS

| | | | |
|---|---|---|---|
| 1,664,887 | A | 4/1928 | Kirkham et al. |
| 2,457,619 | A | 12/1948 | Yocum |
| 3,012,596 | A | 12/1961 | Skolout |
| 3,797,049 | A | 3/1974 | De Santo |
| 3,844,539 | A | 10/1974 | Abbott |
| 4,815,301 | A | 3/1989 | Deloughery |
| 5,134,857 | A | 8/1992 | Burley |
| 5,385,520 | A | 1/1995 | Lepine et al. |
| 5,488,745 | A | 2/1996 | Barrera |
| 5,771,706 | A | 6/1998 | Lavigne |

(Continued)

FOREIGN PATENT DOCUMENTS

| | | | |
|---|---|---|---|
| AU | 619366 | B2 | 1/1992 |
| CA | 2538721 | A1 | 6/2019 |

(Continued)

*Primary Examiner* — Kien T Nguyen

(74) *Attorney, Agent, or Firm* — Hibbs Law, LLC; Genna S. Hibbs

(57) ABSTRACT

A self-standing modular structure support is provided for a self-standing structure having a perimeter component. The self-standing structure support comprises a first member, the first member comprising a perimeter component receiving portion; a second member, being disposed, during use of the self-standing modular structure, in a generally horizontal plane, the second member extending, during the use, outwardly from an exterior surface of the perimeter component; and a third member, the third member being configured to detachably connect the first member to the second member; the first member being supported, during the use, on the second member; the support being configured to support the perimeter component without use of straps and without use of ground engaging projections when the perimeter component is received within a perimeter component receiving portion of the first member. The perimeter component can comprise a plurality of side panels. The structure can further support floor tiles.

22 Claims, 10 Drawing Sheets

(56) References Cited

U.S. PATENT DOCUMENTS

| | | | | |
|---|---|---|---|---|
| 5,897,438 | A | 4/1999 | Kunz et al. | |
| 5,937,586 | A | 8/1999 | Scherba | |
| 5,946,756 | A | 9/1999 | Mapp | |
| 6,230,451 | B1 * | 5/2001 | Stoller | A63C 19/10 52/169.7 |
| D481,138 | S | 10/2003 | Forster et al. | |
| 6,742,198 | B2 | 6/2004 | Lee | |
| 7,204,763 | B2 | 4/2007 | Beynon | |
| 7,374,141 | B2 | 5/2008 | Holden | |
| 8,656,655 | B2 * | 2/2014 | Thiessen | B65D 90/24 52/169.8 |
| 9,022,335 | B2 | 5/2015 | Randazzo et al. | |
| 9,833,689 | B2 | 12/2017 | Smith | |
| 2017/0001094 | A1 * | 1/2017 | Oh | A63C 19/08 |
| 2018/0119430 | A1 * | 5/2018 | Gautreau | E04F 15/181 |
| 2018/0318701 | A1 * | 11/2018 | Merlot | A63C 19/10 |
| 2020/0179792 | A1 * | 6/2020 | Gastel | A63C 19/10 |

FOREIGN PATENT DOCUMENTS

| | | | |
|---|---|---|---|
| CA | 2777394 | A1 | 6/2019 |
| EP | 0123137 | A2 | 7/2019 |
| KR | 101114985 | B1 | 3/2012 |
| KR | 20140097707 | A | 8/2014 |
| KR | 20140097708 | A | 8/2014 |
| WO | 2012174668 | A1 | 12/2012 |

* cited by examiner

SELF-STANDING MODULAR STRUCTURE AND SUPPORT THEREOF

CROSS REFERENCE

This application is the non-provisional, utility application for, and claims the benefit of provisional application No. 63/200,385, titled, "Self-Standing Modular Structure and Support Thereof," filed on 3 Mar. 2021, by inventor, Jim Stoller, and is incorporated here by reference, including the specifications.

TECHNICAL FIELD

The subject matter relates to modular structures. It further relates to self-standing structures. It further relates to ice skating rinks.

BRIEF DESCRIPTION OF DRAWINGS

Non-limiting and non-exhaustive examples of several of the various embodiments of the present subject matter are described with references to the following figures, and reference numbers refer to the same features throughout the various views and embodiments unless otherwise specified.

Figure 1:
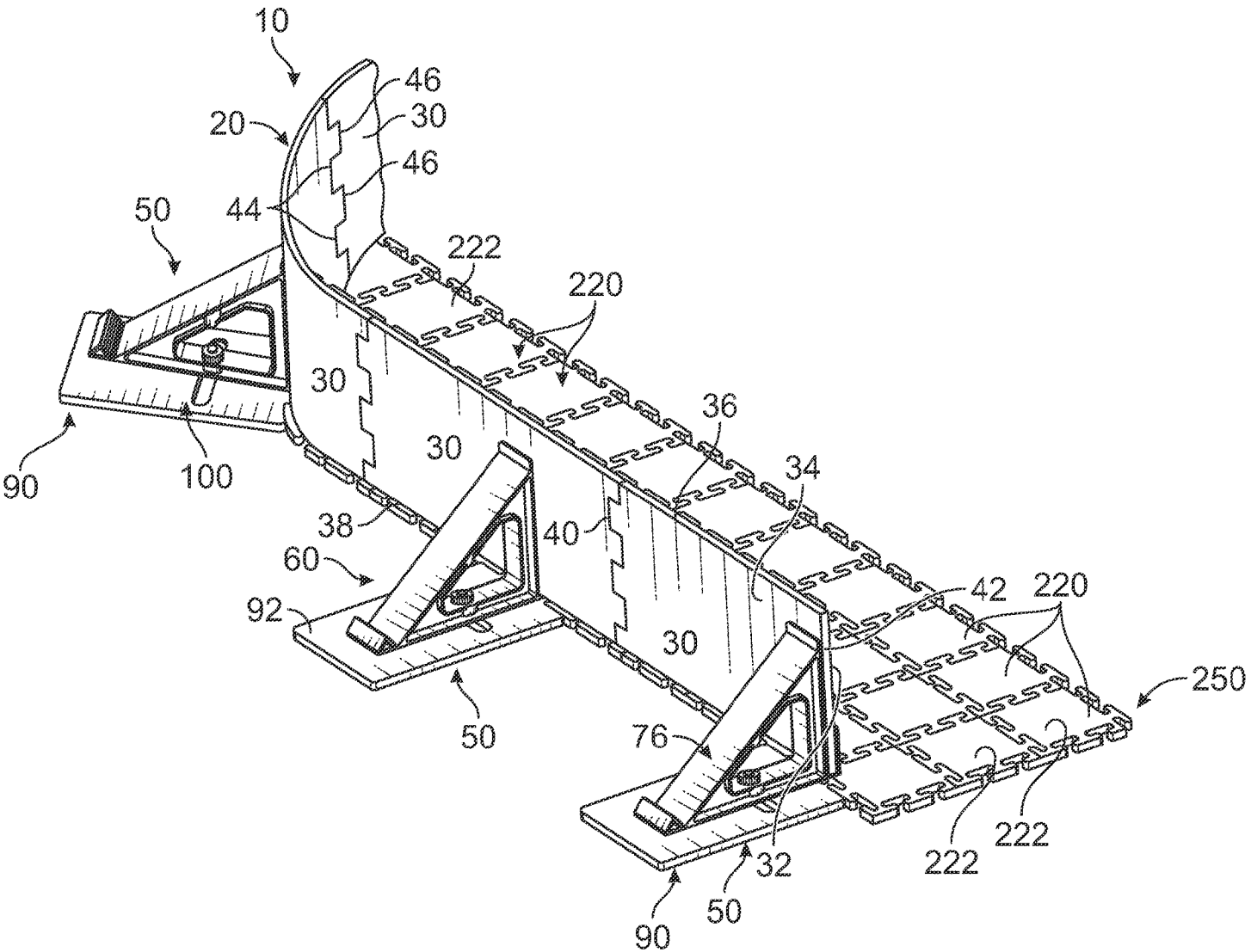
FIG. 1 is an example illustration of an embodiment of the invention showing a structure. The illustration further shows the structure as a self-standing structure with a first member comprising of a perimeter component, a second member extending from the exterior surface of the perimeter component, and a third member detachably connected to the second member.

Corresponding reference characters indicate corresponding components throughout the several views of the drawings. Skilled artisans will appreciate that elements in the figures are illustrated for simplicity and clarity and have not necessarily been drawn to scale. Also, common but well-understood elements that are useful or necessary in a commercially feasible embodiment are often not depicted in order to facilitate a less obstructed view of these various embodiments. Additionally, the disclosed architecture is sufficiently configurable, such that it may be utilized in ways other than what is shown.

DETAILED DESCRIPTION OF EXEMPLARY EMBODIMENTS

In this Specification, which includes the figures, claims, and this detailed description, reference is made to particular and possible features of the embodiments of the subject matter, including method steps. These particular and possible features are intended to include all possible combinations of such features, without exclusivity. For instance, where a feature is disclosed in a specific embodiment or claim, that feature can also be used, to the extent possible, in combination with and/or in the context of other aspects and embodiments of the subject matter, and in the subject matter generally. Additionally, the disclosed architecture is sufficiently configurable, such that it may be utilized in ways other than what is shown.

The purpose of the Abstract of this Specification is to enable the U.S. Patent and Trademark Office and the public generally, and especially the scientists, engineers and practitioners of the art who are not familiar with patent or legal terms or phrasing, to determine quickly from a cursory inspection the nature and essence of the technical disclosure of the application. The Abstract is not intended to be limiting as to the scope of the subject matter in any way.

In the following description, numerous specific details are given in order to provide a thorough understanding of the present embodiments. It will be apparent, however, to one having ordinary skill in the art, that the specific detail need not be employed to practice the present embodiments. On other instances, well-known materials or methods have not been described in detail in order to avoid obscuring the present embodiments. When limitations are intended in this Specification, they are made with expressly limiting or exhaustive language.

Reference throughout this Specification to "one embodiment", "an embodiment", "one example" or "an example" means that a particular feature, structure, or characteristic described in third member with the embodiment or example is included in at least one embodiment of the present embodiments. Thus, appearances of the phrases "in one embodiment", "according to an embodiment", "in an embodiment", "one example", "for example", "an example", or the like, in various places throughout this Specification are not necessarily all referring to the same embodiment or example. Furthermore, the particular features, structures, or characteristics may be combined in any suitable combinations and/or sub-combinations in one or more embodiments or examples.

The terms "comprises", "comprising", "includes", "including", "has", "having", "could", "could have" or their grammatical equivalents, are used in this Specification to mean that other features, components, materials, steps, etc. are optionally present as a non-exclusive inclusion. For instance, a device "comprising" (or "which comprises") components A, B, and C can contain only components A, B, and C, or can contain not only components A, B, and C but also one or more other components. For example, a method comprising two or more defined steps can be carried out in any order or simultaneously, unless the context excludes that possibility; and the method can include one or more other steps which are carried out before any of the defined steps, between two of the defined steps, or after all the defined steps, unless the context excludes that possibility.

For purposes here, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes here, the words "comprising," "including," "having," and variants thereof, wherever they appear, shall be construed as open-ended terminology, with the same meaning as if the phrase "at least" were appended after each instance thereof.

Examples or illustrations given are not to be regarded in any way as restrictions on, limits to, or express definitions of any term or terms with which they are utilized. Instead, these examples or illustrations are to be regarded as being described with respect to one particular embodiment and as being illustrative only. Those of ordinary skill in the art will appreciate that any term or terms with which these example or illustrations are utilized will encompass other embodiments, which may or may not be given in this Specification, and all such embodiments are intended to be included within the scope of that term or terms. Language designating such nonlimiting examples and illustrations includes, but is not limited to "for example", "for instance", "etc.", "or otherwise", and "in one embodiment."

The phrase "at least" followed by a number is used to denote the start of a range beginning with that number, which may or may not be a range having an upper limit, depending on the variable defined. For instance, "at least 1" means 1 or more.

In this specification. "a" and "an" and similar phrases are to be interpreted as "at least one" and "one or more." In this specification, the term "may" or "can be" or "could be" is to be interpreted as "may, for example." In other words, the term "may" is indicative that the phrase following the term "may" is an example of one of a multitude of suitable possibilities that may, or may not, be employed to one or more of the various embodiments.

The term "couple" or "coupled" when used in this specification and appended claims refers to an indirect or direct physical third member between the identified elements, components, or objects. Often the manner of the coupling will be related specifically to the manner in which the two coupled elements interact.

The term "directly coupled" or "coupled directly," when used in this specification and appended claims, refers to a physical third member between identified elements, components, or objects, in which no other element, component, or object resides between those identified as being directly coupled.

The terms "removable", "removably coupled", "removably disposed," "readily removable", "readily detachable", "detachably coupled", "separable," "separably coupled," "releasably attached", "detachably attached", "detachably connected" and similar terms, when used in this specification and appended claims, refer to structures that can be uncoupled, detached, uninstalled, or removed from an adjoining structure with relative ease (i.e., non-destructively, and without a complicated or time-consuming process), and that can also be readily reinstalled, reattached, or coupled to the previously adjoining structure.

As used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa. Similarly, subject matter that is recited as being configured to perform a particular function may additionally or alternatively be described as being operative to perform that function.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The phrase "a plurality of" followed by a feature, component, or structure is used to mean more than one, specifically including a great many, relative to the context of the component.

It is the applicant's intent that only claims that include the express language "means for" or "step for" be interpreted under 35 U.S.C. § 112. Claims that do not expressly include the phrase "means for" or "step for" are not to be interpreted under 35 U.S.C. § 112.

The disclosure of this patent document incorporates material which is subject to copyright protection. The copyright owner has no objection to the facsimile reproduction by anyone of the patent document or the patent disclosure, as it appears in the Patent and Trademark Office patent file or records, for the limited purpose required by law, but otherwise reserves all copyright rights whatsoever.

The particular embodiments of the present disclosure generally provide devices, systems and methods directed to self-standing modular structures.

In particular embodiments, a modular structure comprises a perimeter component, second members disposed external to the perimeter component, and supporting first members, each supporting first member being detachably attached to a respective second member, the supporting first members and the second members configured to support the perimeter component without use of straps and without use of ground engaging projections when the perimeter component is received within a perimeter component receiving portion in each supporting first member.

In particular embodiments, a first member for a modular structure, for example such as an ice skating rink, consists only of a J-shaped first portion, a base extending from the J-shaped first portion, the base comprising a first surface and a second surface, the second surface being disposed at a distance from the first surface to define a thickness of the base member, a bracing member coupling the J-shaped support to the base member, the bracing member being disposed at an acute angle to each of the J-shaped first portion and the base member, the bracing member defining a hollow interior of the first member, and an aperture disposed though the thickness of the base member in an open communication with the hollow interior.

In particular embodiments, therein is provided a portable and modular playing arena that can be readily assembled to provide a surface which can be flooded with water and frozen to present an ice skating rink or, which during times of warmer weather, can be used for purposes of playing basketball, ball hockey and for in-line skating. When desired the arena can be disassembled and stored.

Now in a reference to FIG. 1 which is an example of an illustration of an embodiment of the invention showing a structure 10. The structure 10 is being further illustrated as a self-standing structure. The self-standing structure comprises of a first member 60, a second member 90, with a first surface 92, a third member 100, connecting the first member 60 to the second member 90. The second portion or base 70, of the first member 60 (not shown in FIG. 1) comprises of a third portion/brace 76. The structure 10 comprises a perimeter component 20. The perimeter component 20, is also a peripheral side wall, a portable perimeter component, or a modular perimeter component in some embodiments of the invention. The perimeter component 20 comprises a plurality of side panels 30. The side panel 30 can be also referred to as a board 30. Each side panel 30 comprises a first surface of the side panel 32, a second surface of the side panel 34, first edge of the side panel 36 that defines, during use, an upper edge of the side panel 30, a second edge of the side panel 38 that defines, during use, a lower edge of the side panel 30, a third edge of the side panel 40 that is disposed, during use generally vertically and a fourth edge of the side panel 42 that is also disposed, during use, generally vertically. The second surface of the side panel 34 is being disposed at a distance from the first surface of the side panel 32 to define a thickness of the side panel 30. The second edge of the side panel 38 is being disposed at a distance from the first edge of the side panel 36 to define a width of the side panel 30. The width becomes a height of the side panel 30 during use thereof. The fourth edge of the side panel 42 is being disposed at a distance from the third edge of the side panel 40 to define a length of the side panel 30. The third edge of the side panel 40 comprises of notches 44 and projections 46 that are configured to mesh or interlock with the notches 44 and projections 46 in the fourth edge of the side panel 42 of the adjacent side panel 30. Likewise, the fourth edge of the side panel 42 comprises notches 44 and projections 46 that are configured to mesh or interlock with the notches 44 and projections 46 in the third edge of the side panel 42 of the adjacent side panel 30. Prior to use of the structure 10, the side panels 30 are positioned in series with each other and opposing edges, i.e., the third and fourth edges, 40, 42 of adjacent side panels are interlocked with each other by way of notches 44 and projections 46. Each side panel 30 can be referred to in this document as a module of the perimeter component 20. Furthermore, each side panel 30 can be referred to in this document as an interlocking panel. Thus, the perimeter component 20 can be also referred to as a modular perimeter component 20 and the structure 10 can be also referred to as a modular structure 10. Furthermore, the structure 10 can be disassembled by detaching side panels 30 from each other, moved to a different location and re-assembled. Thus, the perimeter component 20 can be also referred to as a portable perimeter component 20 and the structure 10 can be also referred to as a portable structure 10. Furthermore, the perimeter component 20 can be also referred to as a peripheral side wall 20 with the surface 22 being an exterior surface of such peripheral side wall 20. The structure 10 also has plurality of panels/tiles 220 which interlock by way of connecting the individual tile surfaces 222, to form the base of the ice skating rink. These panels 220, comprise of a first shape 240 (not shown in FIG. 1) and a second shape 250.

Figure 2:
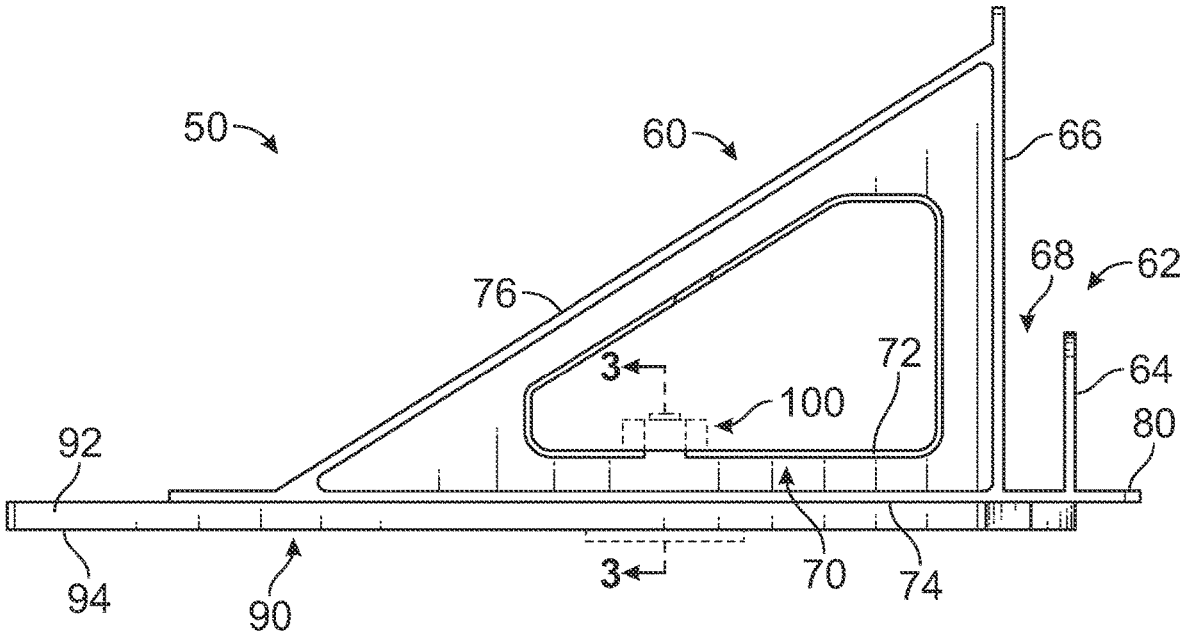
FIG. 2 is an example illustration of an embodiment of the invention showing a support which can removably support the structure, which can be a self-standing structure, without use of straps, or without use of ground engaging projections. The illustration further shows the support comprising of a first member, a second member, and a third member. The cutting plane 3 (with associated arrows) is also shown in FIG. 2.

The structure 10 is being further illustrated in FIGS. 1-2 as comprising supports 50. The supports 50 are positioned, during use, external to the second surface of the side panels 34, where the second surface of the side panel 34 defines an exterior surface of the side panel 30. All second surfaces of the side panels 34 define the exterior surface of the perimeter component/peripheral side wall 22. The supports 50 are further positioned, during use, in series with each other and at a distance from each other, along the exterior surface of the perimeter component 22. In an example, one support 50 can be positioned at each side panel 30. In another example, some side panels 30 can be used without the support 50. In another example, more than one support 50 can be provided at each side panel 30. The supports 50 removably support the perimeter component 20 in an upright vertical position.

In an embodiment of the invention, as seen in FIG. 2, each support 50 comprises a first member 60, a second member 90 and a third member 100 between the first member 60 and the second member 90. In an example, the first member 60 can be referred to as a bracket 60. In an example, the first member 60 can be referred to as a supporting member 60. In an example, the first member 60 can be referred to as a base 70. In an example, the first member 60 can be referred to as a retaining buttress 60. In an example, the second member 90 can be referred to as a pad 90. In an example, the second member 90 can be referred to as a retaining anchor plate. In an example, the third member 100 can be referred to as a connection.

As it will be explained further in this document, the support 50 is being configured to support the perimeter component 20 without use of straps and without use of ground engaging projections when the perimeter component 20 is received within a perimeter component receiving portion in each first member 60.

When the support 50 comprises separate first member 60 and second member 90, the interlocking third member 260 will be between the second member 90 and the selective tile 220, as the second member 90 will be positioned planar with the grid of tiles 220. When the support 50 is provided as a unitary member, the interlocking third member 260 will be between the second portion of the first member 70 and the selective tile 220.

Although, the, the second shape 250 have been illustrated as protruding past the exterior surface 32 of the side panel 30, such second shape 250 can be disposed under the thickness of the side panel 30 or even disposed inwardly from the inner surface 34.

Furthermore, when the structure 10 comprises a grid of tiles 220, the above described flange of second portion 80 abuts a portion of the surface 222, thus applying a force onto the respective tile 220 due to the weight of the support 50 and, more particularly, due to the weight of the side panel 30 received within the support 50.

The structure 10 of any of the above described embodiments can be described as a self-locking structure in that the support 50 interlocks with the tile 220 and the side panel 30 interlocks with the support 50 and applies downward force onto the tile 220.

In an example of FIG. 2, the first member 60 comprises a perimeter component receiving portion 62. Such perimeter component receiving portion 62 is being illustrated as a J-shaped first portion 62. The J-shaped first portion 62 defines a first leg 64 and a second leg 66. The second leg 66 is disposed at a distance from the first leg 64 to define a receptacle 68. The receptacle 68 is sized and shaped to receive a portion of the side panel 30 therewithin. The first member 60 further comprises a second portion of the first member 70. The second portion of the first member 70 extends outwardly from and generally perpendicular to the J-shaped first portion 62. The second portion of the first member 70 extends in a direction being opposite to the direction of the receptacle 68. The second portion of the first member 70 comprises a first surface of the second portion 72 and a second surface of the second portion 74. The second surface of the second portion 74 is being disposed at a distance from the first surface of the second portion 72 to define a thickness of the second portion of the first member 70. It would be further understood that the first leg 64 and the second portion of the first member 70 define an L-shape configuration of the first member 60. The first leg 64 and the second portion of the first member 70 are being illustrated as having generally identical width. However, the second portion of the first member 70 can be wider or narrower than the first leg 64. Likewise, the second leg 66 can be wider or narrower than the first leg 64. The first member 60 in this example, can comprise a flange of second portion 80. The flange of second portion 80, when provided, extends outwardly from the second leg 66. During use of the first member 60, the flange of second portion 80 is disposed generally horizontally. The second portion of the first member 70 can be referred to as a base of the first member 60. The third portion 76 can be also referred to as a brace.

In an example of FIG. 2, the first member 60 comprises a perimeter component receiving portion 62. Such perimeter component receiving portion 62 is being illustrated as a J-shaped first portion 62. The J-shaped first portion 62 defines a first leg 64 and a second leg 66. The second leg 66 is disposed at a distance from the first leg 64 to define a receptacle 68. The receptacle 68 is sized and shaped to receive a portion of the panel 30 therewithin. The receptacle 68 can be also referred to as the above stated perimeter component receiving portion. The first member 60 further comprises a second portion of the first member 70. The second portion of the first member 70 extends outwardly from and generally perpendicular to the J-shaped first portion 62. The second portion of the first member 70 extends in a direction being opposite to the direction of the receptacle 68. The second portion of the first member 70 comprises a first surface of the second portion 72 and a second surface of the second portion 74. The second surface of the second portion 74 is being disposed at a distance from the first surface of the second portion 72 to define a thickness of the second portion 70. The first member 60 also comprises a third portion 76 coupling the J-shaped first portion to the base member 70. The third portion 70 is being disposed at an acute angle to each of the J-shaped first portion 62 and the second portion 70. The third portion 76 defines, in a combination with the first leg 64 and the second portion 70, a hollow interior 78 of the first member 60. During use, the third portion 76 at least resists if not prevents undesirable bending of the first leg 64 toward the second portion 70. It would be further understood that the first leg 64 and the second portion of the first member 70 define an L-shape configuration of the first member 60. The first leg 64 and the second portion of the first member 70 are being illustrated as having generally identical width. However, the second portion of the first member 70 can be wider or narrower than the first leg 64. Likewise, the second leg 66 can be wider or narrower than the first leg 64. The second portion of the first member 70 can be referred to as a base of the first member 60. The third portion 76 can be also referred to as a brace. Furthermore, while the third portion is also being illustrated as having a generally identical width with the first portion 62 and the second portion 70, the third portion 76 can be provided in smaller or greater widths. Furthermore, one or both ends of the third portion 76 can be spaced from a respective end of the first portion 62 or/and the second portion 70. Additionally, the third portion 76 can be rotated 90 degrees from the position illustrated in FIG. 2.

In a further example of FIG. 2, the first member 60 comprises a perimeter component receiving portion 62. Such perimeter component receiving portion 62 is being illustrated as a J-shaped first portion 62. The J-shaped first portion defines a first leg 64 and a second leg 66. The second leg 66 is disposed at a distance from the first leg 64 to define a receptacle 68. The receptacle 68 is sized and shaped to receive a portion of the panel 30 therewithin. The receptacle 68 can be also referred to as the above stated perimeter component receiving portion. The first member 60 further comprises a second portion of the first member 70. The second portion of the first member 70 extends outwardly from and generally perpendicular to the J-shaped first portion 62. The second portion of the first member 70 extends in a direction being opposite to the direction of the receptacle 68. The second portion of the first member 70 comprises a first surface of the second portion 72 and a second surface of the second portion 74. The second surface of the second portion 74 is being disposed at a distance from the first surface of the second portion 72 to define a thickness of the second portion of the first member 70. The first member 60 also comprises a third portion 76 coupling the J-shaped first portion to the base member 70. The third portion 76 is being disposed at an acute angle to each of the J-shaped first portion 62 and the second portion of the first member 70. The third portion 76 defines, in a combination with the first leg 64 and the second portion of the first member 70, a hollow interior 78 of the first member 60. During use, the third portion 60 at least resists if not prevents undesirable bending of the first leg 64 toward the second portion of the first member 70. It would be further understood that the first leg 64 and the second portion of the first member 70 define an L-shape configuration of the first member 60. The first leg 64 and the second portion of the first member 70 are being illustrated as having generally identical width. However, the second portion of the first member 70 can be wider or narrower than the first leg 64. Likewise, the second leg 66 can be wider or narrower than the first leg 64. The first member 60 in this example also comprises a flange of second portion 80. The flange of second portion 80 extends outwardly from the second leg 66. During use of the first member 60, the flange of the second portion 80 is disposed generally horizontally.

Now in a reference to FIG. 2, the second member 90 comprises a first surface 92 and a second surface 94. The second surface 94 being disposed at a distance from the first surface 92 to define a thickness of the second member 90. The second member 90 is being illustrated as having a rectangular shape, although other shapes are being contemplated herewithin. Further, although the first surface of the second member 92 and the second surface of the second member 94 are being illustrated as flat surfaces, thus defining a uniform thickness of the second member 90, non-flat, in other words irregular, surfaces are contemplated herewithin.

The third member 100 can be implemented in a number of different configurations. The third member 100 can be configured to detachably connect or couple the first member 60 to second member 90 with a fastener.

Figure 3A:
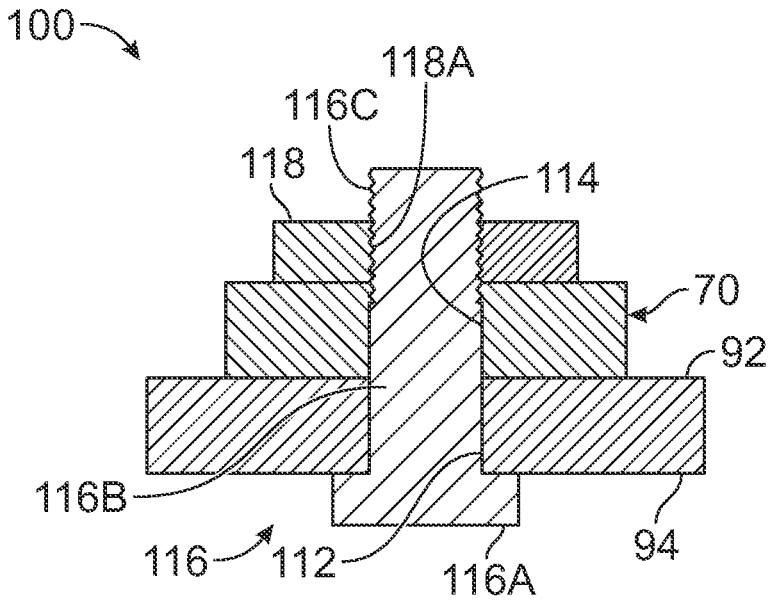
FIGS. 3A, 3B, 3C, 3D, 3E, 3F, and 3G are a sectional view showing different possible embodiments of the third member which provides means for fastening the first member to the second member.
Figure 3B:
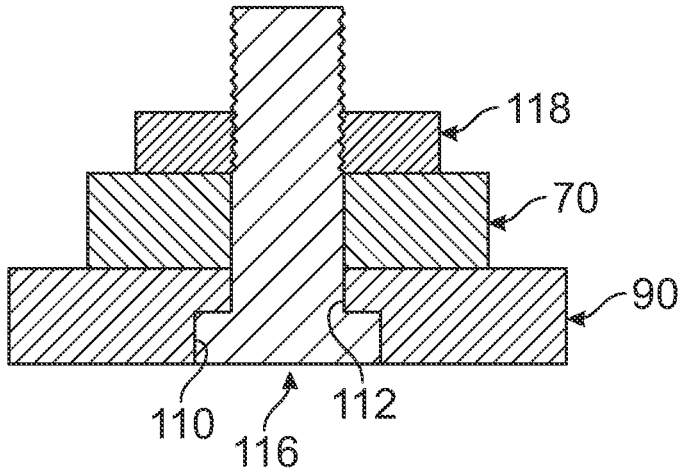

In an example of FIG. 3B, the third member 100 comprises a cavity 110, a first aperture 112, a second aperture 114, a first fastener 116 and a second fastener 118. The cavity 110 is provided within the thickness of the second member 90 and is defined by a reduced thickness portion of the second member 90. The first aperture 112 extends through the reduced thickness portion of the second member 90. A size of the first aperture 112 being smaller than a size of the cavity 110. The second aperture 114 extends through a thickness portion in the first member 60. More specifically, the second aperture 114 extends through the thickness of the second portion 70. The first fastener 116 comprises a first portion 116A and a second portion 116B. The first portion 116A is being sized and shaped to be received within the cavity 110. The second portion 116B is being sized to pass through the first and second apertures, 112 and 114 respectively. The first portion 116A is being sized larger than the second portion 116B. The fastener 116 also comprises an external thread 116C on the second portion 116B. The external thread 116C protrudes, during the use, past the thickness of the first member 60, and more specifically past the thickness of the second portion 70. The second fastener 118 comprising an internal thread 118A. The internal thread 118A being complimentary to the external thread 116C so that second fastener 118 can threadably engage the first fastener 116 so as to detachably couple the first member 60 to the second member 90. The first fastener 116 is illustrated as a threaded screw and the second fastener 118 is illustrated as a nut. Each of the cavity 110 and the first aperture 112 can define an elongated shape, where the elongated shape comprises a length being greater than a width, the length disposed generally parallel to the exterior surface 22 during use of the modular structure 10. A thickness of the cavity 112 can be the same thickness as a thickness of the first portion 116A. Then, during use, an exterior surface of the first portion 116A will be generally flush with the bottom surface of the second member 90, where the bottom surface is referenced with numeral 94. The term "generally flush" is intended to mean that the fastener surface is even with the surface 94, inset into the thickness of the second member 90 from the surface 94 or protrudes slightly from the surface 94.

In an example of FIG. 3A, the third member 100 can be provided without the cavity 110. In this example, the thickness of the first portion 116A will protrude past the bottom surface of the second member 90, where the bottom surface is referenced with numeral 94. The first surface of the second member 92 can also be seen. In this example, the third member 100 comprises a first aperture 112, a second aperture 114, a first fastener 116 and a second fastener 118. The first aperture 112 extends through a thickness portion of the second member 90. The second aperture 114 extends through a thickness portion in the first member 60. More specifically the second aperture 114 extends through the thickness of the second portion 70. The first fastener 116 comprises a first portion 116A and a second portion 116B. The first portion 116A is being sized and shaped to be received within the cavity 110. The second portion 116B is being sized to pass through the first and second apertures, 112 and 114 respectively. The first portion 116A is being sized larger than the second portion 116B. The first fastener 116 also comprises an external thread 116C on the second portion 116B. The external thread 116C protrudes, during the use, past the thickness of the first member 60, and more specifically past the thickness of the second portion 70. The second fastener 118 comprising an internal thread 118A. The internal thread 118A being complimentary to the external thread 116C so that second fastener 118 can threadably engage the first fastener 116 so as to detachably connect the first member 60 to the second member 90. The first fastener 116 is illustrated as a threaded screw and the second fastener 118 is illustrated as a nut. The first aperture 112 can define an elongated shape, where the elongated shape comprises a length being greater than a width, the length disposed generally parallel to the exterior surface 22 during use of the modular structure 10.

Figure 3C:
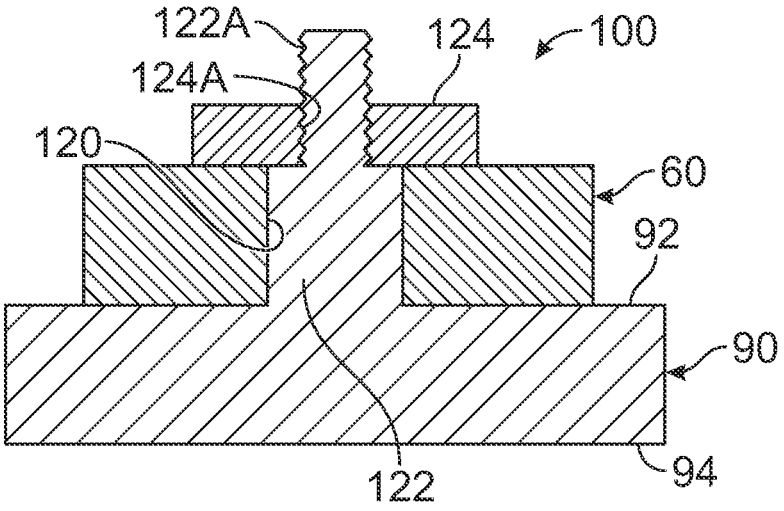

In an example of FIG. 3C, the third member 100 comprises an aperture of the third member 120, a projection 122 and a fastener of third member 124. The aperture of third member 120 extends through a thickness portion in the first member 60. More specifically the aperture 120 extends through the thickness of the second portion of the first member 70. The projection 122 upstands on a surface of the second member 90, which is referenced by numeral 92 and which defines a top surface of the second member 90 during use. The bottom or the second surface of the second member is defined by numeral 94. The projection 122 is being sized and shaped to pass through the aperture 120. The projection 122 comprises an external thread 122A. The external thread 122A protrudes past the thickness of the first member 60. The fastener 124 comprises an internal thread 124A. The internal thread 124A being complimentary to the external thread 122A so that the fastener 124 can threadably engage the projection 122 so as to detachably attach the first member 60 to the second member 90.

Figure 3D:
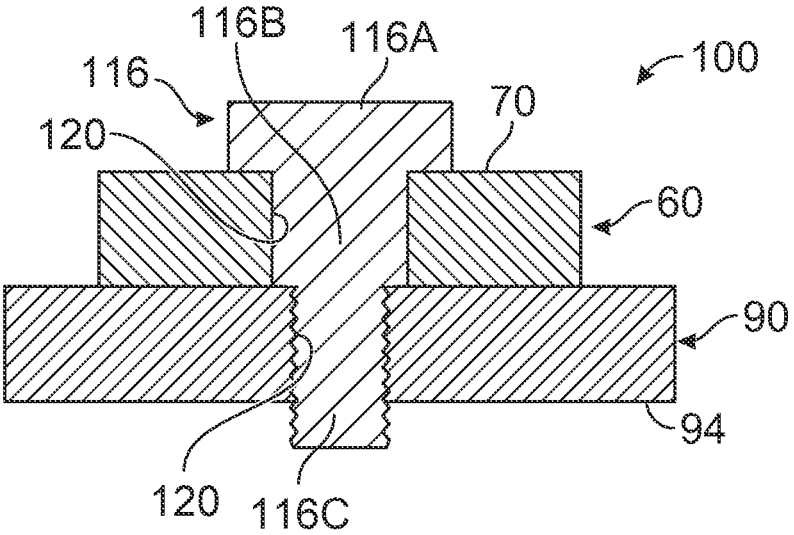

In an example of FIG. 3D, the third member 100 comprises a threaded aperture, an aperture and a fastener. The threaded aperture is provided within the thickness of the second member 90. The threaded aperture can be a through threaded aperture. The aperture extends through a thickness portion in the first member 60. More specifically the aperture extends through the thickness of the second portion 70. The fastener comprises a first portion and a second portion. The first portion is being sized larger than the second portion. The second portion is being sized to pass through aperture. The fastener also comprises an external thread on the second portion. During use, the external thread threadably engages threaded aperture so as to detachably attach the first member 60 to the second member 90.

Figure 3E:
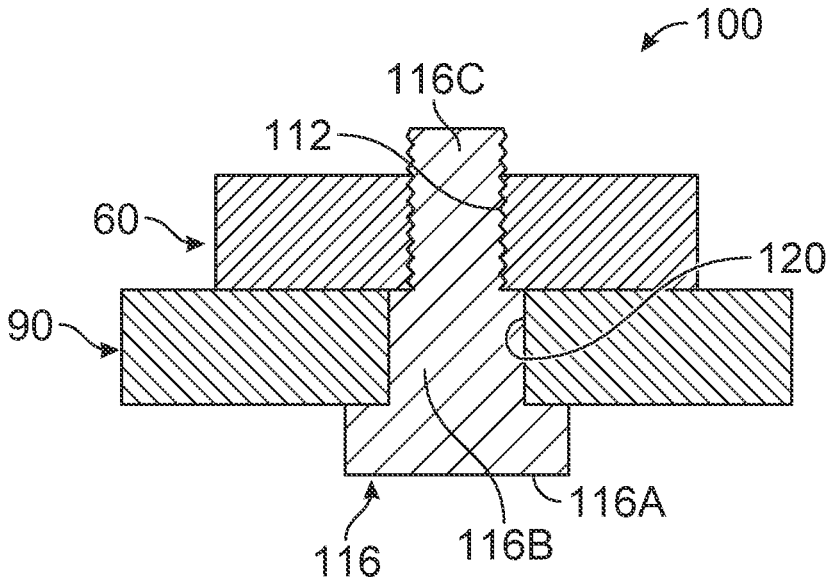

In an example of FIG. 3E, the third member 100 comprises a threaded aperture, an aperture and a fastener. The threaded aperture is provided within a thickness portion in the first member 60. More specifically the aperture extends through the thickness of the second portion 70. The threaded aperture can be a through threaded aperture. The aperture extends through a thickness of the second member 90. The fastener comprises a first portion and a second portion. The first portion is being sized larger than the second portion. The second portion is being sized to pass through aperture. The fastener also comprises an external thread on the second portion. During use, the external thread threadably engages threaded aperture so as to detachably attach the first member 60 to the second member 90.

It would be understood that the above described third member 100 of FIGS. 3A-3E provides means for fastening the first member 60 to the second member 90.

The third member 100 can be configured to detachably connect or couple the first member 60 to the second member 90 without a fastener.

Figure 3F:
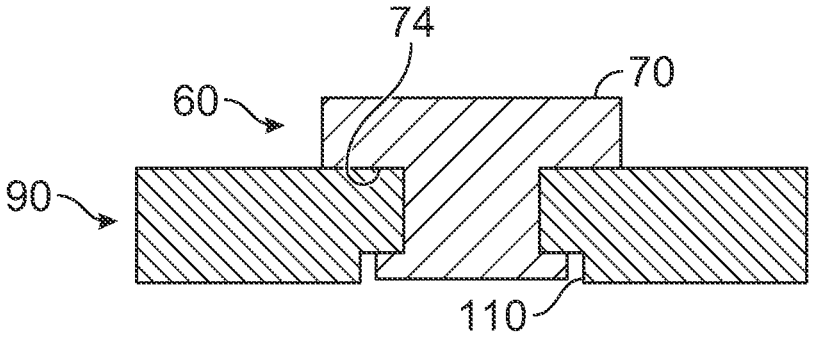

In an example of FIG. 3F, the third member 100 comprises a cavity, an aperture and a projection. The cavity is provided within the thickness of the second member 90 and is defined by a reduced thickness portion of the second member 90. The aperture extends through the reduced thickness portion of the second member 90. The aperture has an elongated shape. A portion of the aperture, for example such as one end thereof, is enlarged. A size of the first aperture is being smaller than a size of the cavity. The projection upstands on a surface of the first member 60. More specifically, the projection upstands on the surface 74 of the second portion of the first member 70, where the second surface of the second portion 74 defines a bottom surface during use of the first member 60. The projection comprises a first portion and a second portion. The second portion is being sized larger than the first portion. The first portion is being sized smaller than the portion. Furthermore, a length of the first portion, as defined by a distance between the surface 74 and the second portion is the same or slightly larger than the reduced thickness portion of the second member 90. During installation, the second portion is passed through the portion to engage the first portion with the aperture. The second portion being than disposed under the aperture to prevent unintended separation of the first member 60 from the second member 90. It would be understood that in this example, the projection interlocks with the aperture. It can be further understood that the in this example, the first member 60 interlocks with the second member 90 in a fastener-free manner.

Figure 3G:
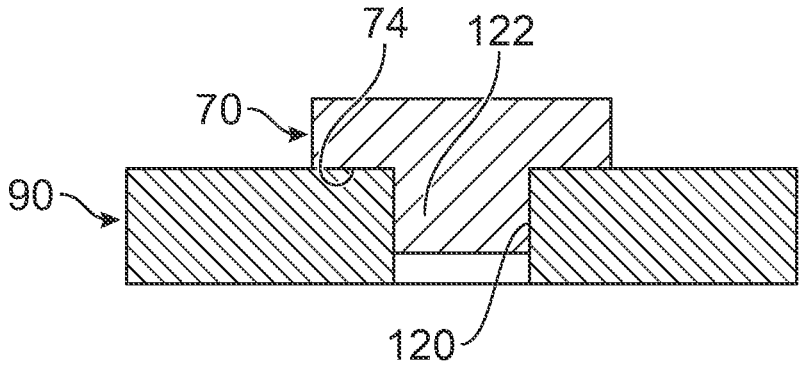

In an example of FIG. 3G, the third member 100 comprises an aperture and a projection. The aperture is provided within the thickness of the second member 90 The aperture can be a through aperture that extends through the thickness of the second member 90. The aperture can have an elongated shape. The projection upstands on a surface of the first member 60. More specifically, the projection upstands on the surface 74 of the second portion 70, where the surface 74 defines a bottom surface during use of the first member 60. The projection is sized and shaped to be received within the aperture. During installation, the projection is simply inserted into the aperture. The projection can also have an elongated shape. Such elongated shape of the projection can be sized smaller than the elongated shape of the aperture. The projection and the aperture can be sized to define a friction fit therebetween. More than one aperture and more than one projection can be provided to enhance resistance of unintended separation of the first member 60 from the second member 90.

It would be understood that the above described third member 100 of FIGS. 3F-3G provides means for detachably attaching the first member 60 to the second member 90 in a fastener-free manner.

Figure 4:
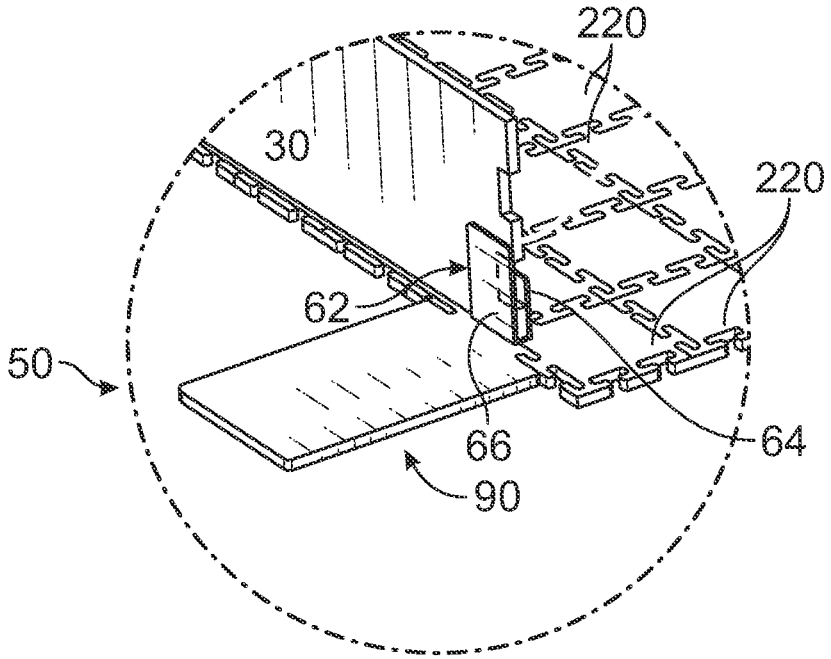
FIG. 4 is an alternate view of a portion of FIG. 1, showing how the perimeter component receiving portion of the first member may be integrated with the plurality of side panels.

Now in a reference to FIG. 4, the support 50 integrates the first member 60 (not labeled in FIG. 4) with the second member 90 into a unitary one-piece member. It would be understood that in this example, the second member 90 becomes the second portion 70 or the second portion of the first member 70 becomes the second member 90. In other words, the support 50 in this example comprises a J-shaped first portion 62 and the second portion of the first member 70. The J-shaped first portion further comprises of first leg 64 and second leg 66. As it has been said above, the width of the second portion of the first member 70 can be sized large than the width of the first leg 62. The first member 60 in this example can also comprise the third portion 76. The second member/portion 90 can be also referred to as a base of the support 50. It will be further understood that the third member 100 is either eliminated in the support of FIG. 4 or becomes the integral connection between the J-shaped first portion 62 and the second portion of the first member 70. The ice rink can be formed by interlocking the panels 220.

The structure 10 can be used as a portable and modular playing structure 10. The portable and modular playing structure can be an ice skating arena or an ice skating rink 10.

In an embodiment when the structure 10 is provided for ice skating purposes, a liner 200 can be placed on the side panels 30 and laid within the perimeter component 20 so that water may be poured into the cavity defined by the liner 200 and not escape into the ground. When the water freezes, it provides am ice skating surface. The liner 200 can comprise of a water impermeable cloth, such as high density cross-laminated polyethylene, high density isotopically oriented polyethylene or woven high density polyethylene, produced by Sto-Cote Products Co. of Genoa City, Wis. The liner 200 can comprise any type of water impermeable fabric, or fabric treated to make the fabric impermeable to water.

Figure 5:
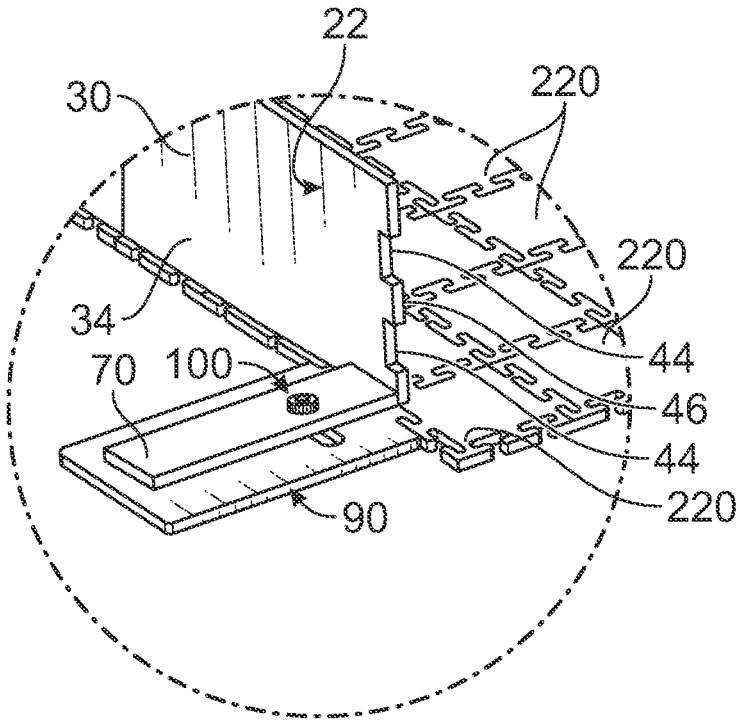
FIG. 5 is an alternate view of a portion of FIG. 1 showing how the base portion of the first member may be connected to the second member with the third member.

In an embodiment, like in FIG. 5, when the structure 10 is provided for ice skating purposes, the ice skating surface can be formed by self-lubricating panels 220 that do not require any surface lubricants or enhancers. The panels 220 can be also referred to as synthetic ice tiles or tiles. During use, the tiles 220 are laid-out horizontally in a grid pattern so that combination of individual tile surfaces 222 form a playing surface that can be also referred to as a floor surface. The grid of tiles 220 can define a closed polygonal shape or any other shape of the playing surface. Generally, the tiles comprise interlocking third members 230 between opposite edges of a pair of adjacent disposed tiles. In other words, each edge of a single tile 220 comprises interlocking features. The interlocking third member 230 can be also referred to as an interconnecting third member. The interlocking third member 230 comprises a first shape 240 and a second shape 250. The first shape 240 is provided in a first tile 220 from two adjacent tiles 220. The second shape 250 is provided in a second tile 220 from two adjacent tiles 220. The second shape 250 being sized to be received within the first shape 240 so that the two adjacent tiles 220 are prevented from an unintentional separation in the generally horizontal plane during use of the modular structure 10. In FIG. 5, the third member 100 is joining second portion of the first member 70 with the second member 90, to form the support for the side panel 30 with exterior surface 22. The side panels make the surrounding structure for the ice skating rink, when the notches 44 and projections 46 of the third and fourth edge of the side panel 30 are joined together.

Figure 6:
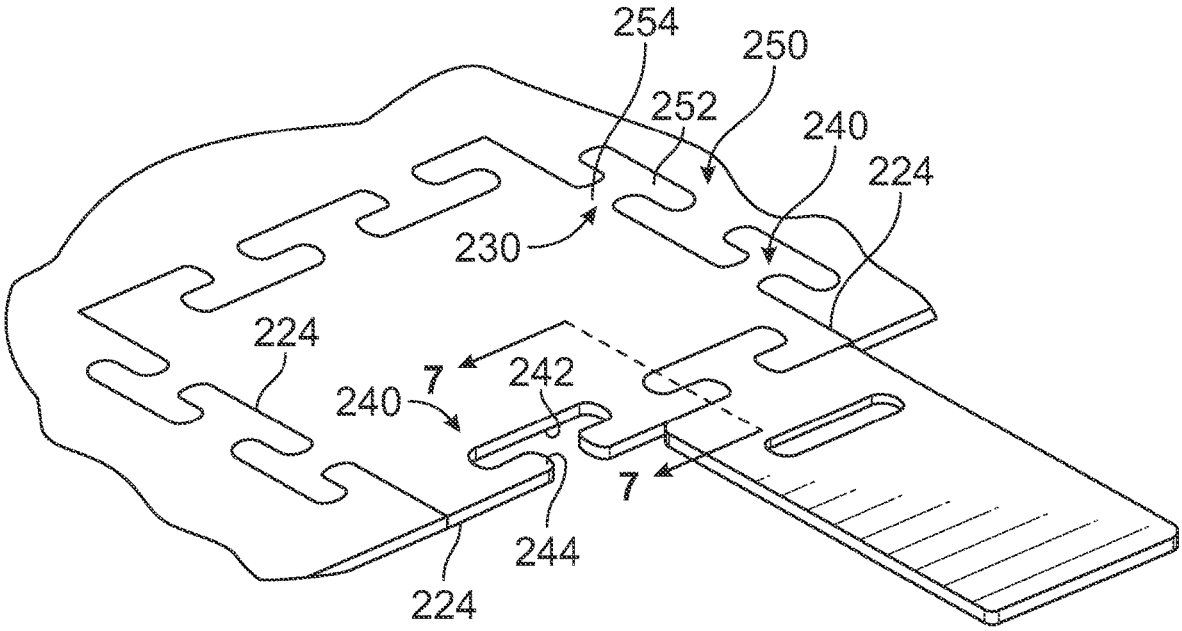
FIG. 6 is a top perspective view of how a second member may connect to the synthetic ice tile.
Figure 7:
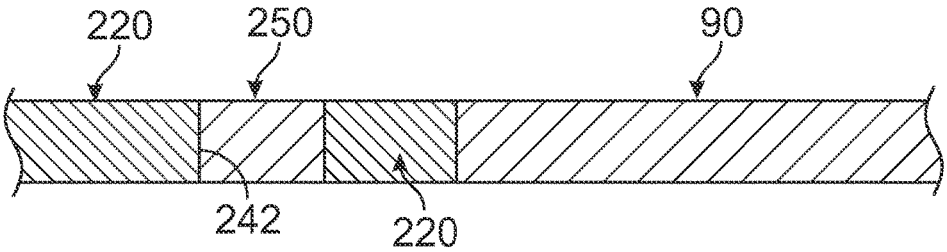
FIG. 7 is a sectional view from FIG. 6 of second member and synthetic ice tile interaction.

In an example of FIGS. 6-7, the first shape 240 comprises a first portion of the first shape 242 and a second portion of the first shape 244. The first portion of the first shape 242 being disposed at a distance inwardly from an edge of the self-lubricating first tile 224 and the second portion of the first shape 242 being in an open communication with the edge of the self-lubricating first tile 224 and with the first portion of the first shape 242. The first portion of the first shape 242 being wider than the second portion of the first shape 244. The second shape 250 comprises a first portion of the second shape 252 and a second portion of the second shape 254. The first portion of the second shape 252 being disposed at the distance outwardly from the edge of the self-lubricating tile 224. The second portion of the second shape 254 bridges a distance between the first portion of the second shape 252 and the edge of the self-lubricating tile 224. The first portion of the second shape 252 being sized to be received within the first portion of the first shape 242 and the second portion of the second shape 254 being sized to be received within the second portion of the first shape 244.

It will be understood that the first shape 240 comprises a cavity in one (first) tile 240, the cavity in one (first) tile 240 being in an open communication with an edge of the tile 222. The second shape 250 comprises a projection that extends from the edge 222 of the tile 220, the second shape 250 being sized to be received within the first shape 240.

Figure 8:
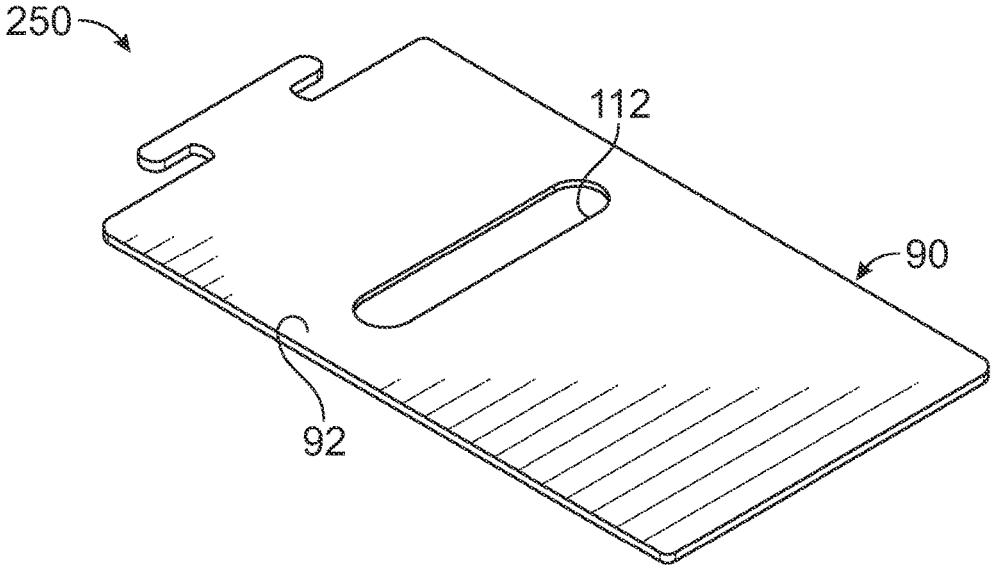
FIG. 8 is a top perspective view of a possible embodiment of the third member.

FIG. 8 shows the second shape 250, with first aperture 112, on the first surface of the second member 90.

Figure 9:
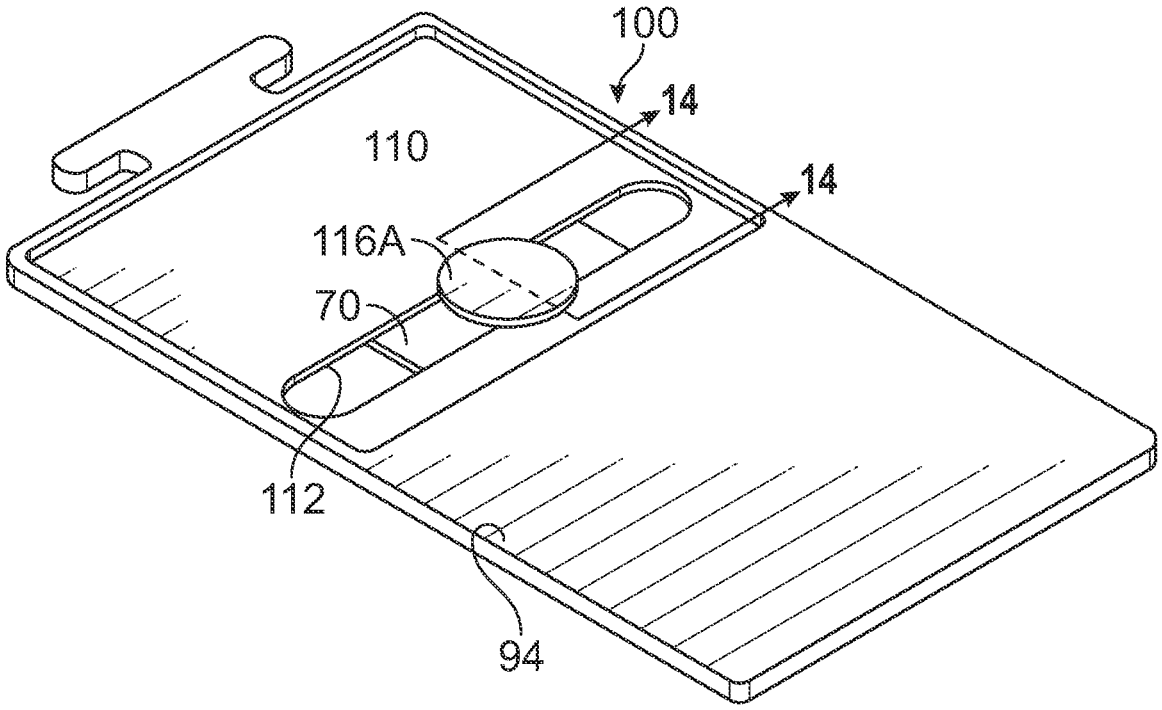
FIG. 9 is a bottom perspective view of a possible embodiment of the third member.

FIG. 9 shows the third member 100, with cavity 110, first portion of the first fastener 116 A, first aperture 112, connecting the second portion 70 to the second surface of the second member 94.

Figure 10:
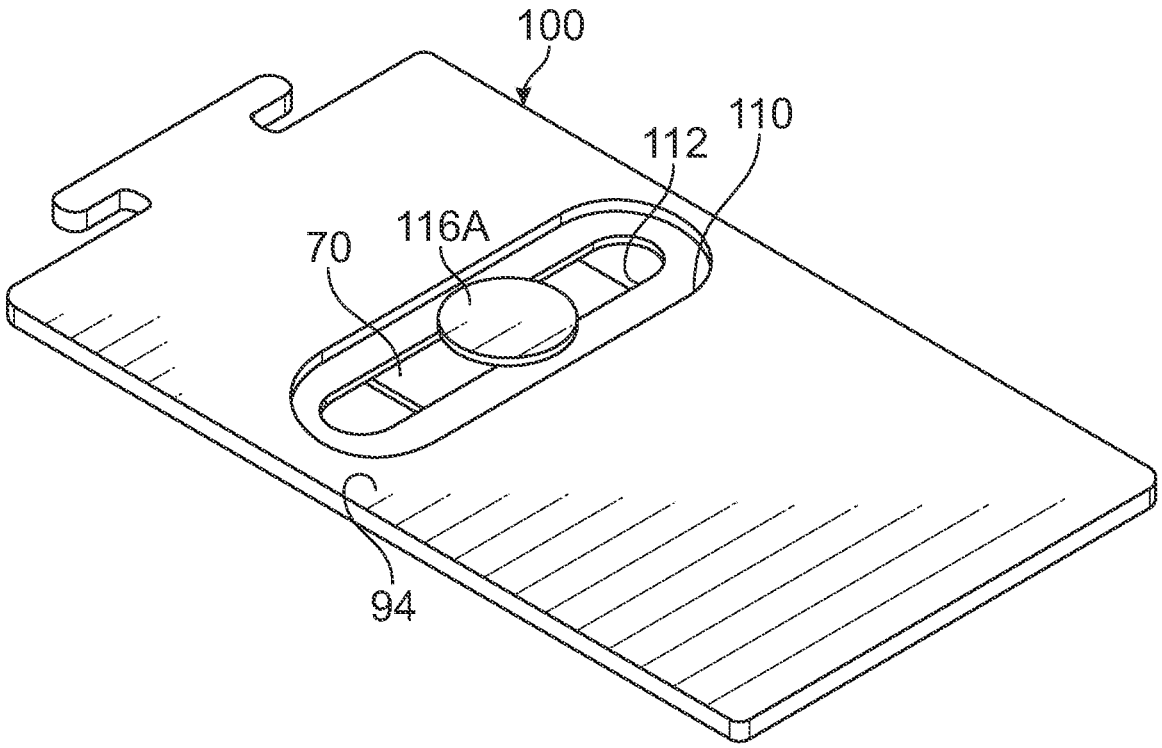
FIG. 10 is a bottom perspective view of a possible embodiment of the third member.

FIG. 10 shows the third member 100, with cavity 110, first aperture 112, first portion of the first fastener 116A, connecting the second portion 70 to the second surface of the second member 94.

Figure 11:
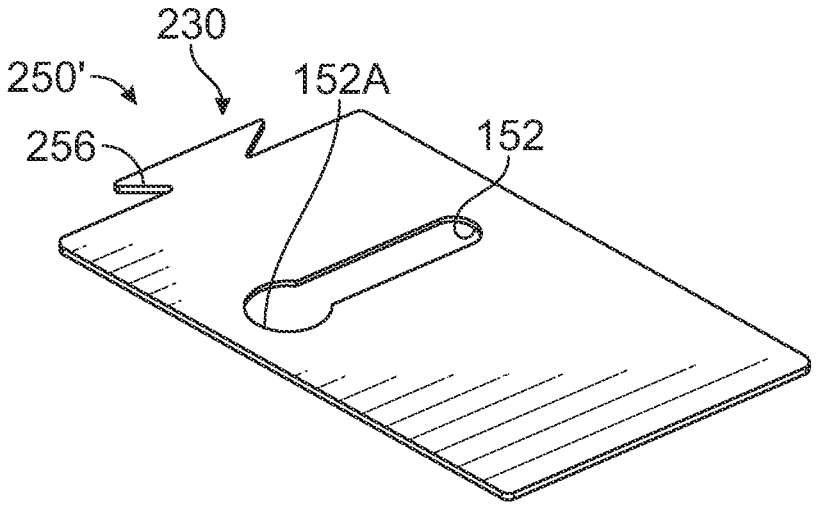
FIG. 11 is a top perspective view of a possible embodiment of the third member.

In an example of FIG. 11, each of the first shape 230 and the second shape 250 comprises tapered edges 250'.

Figure 12:
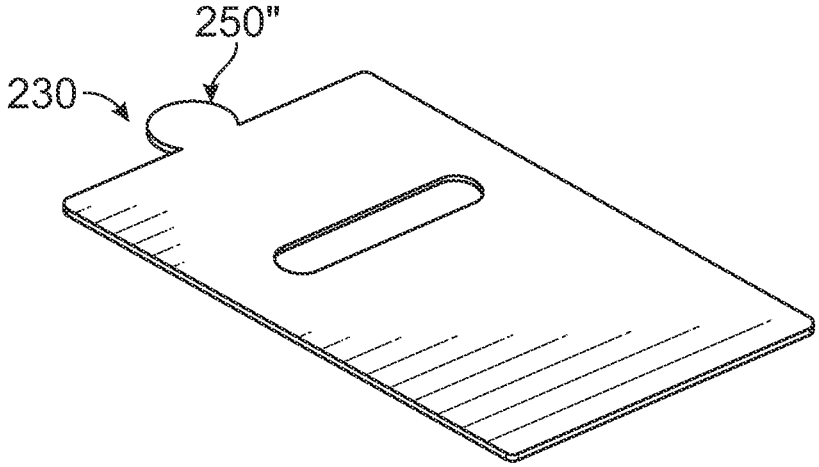
FIG. 12 is a top perspective view of a possible embodiment of the third member.
Figure 13:
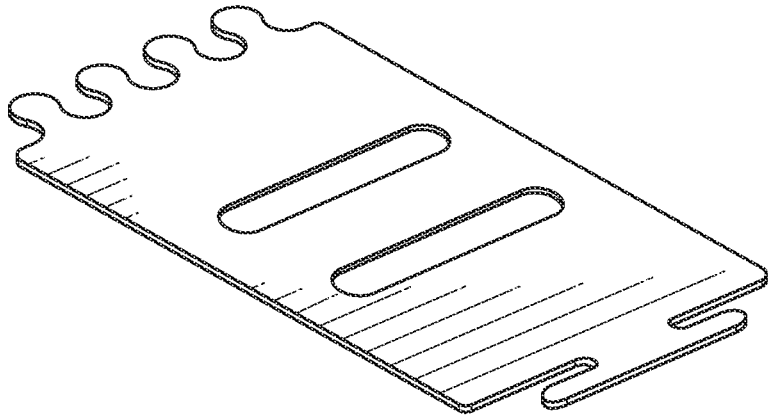
FIG. 13 is a top perspective view of a possible embodiment of the third member.

In an example of FIG. 12, each of the first shape 230 and the second shape 250 is partially round 250".

Figure 14:
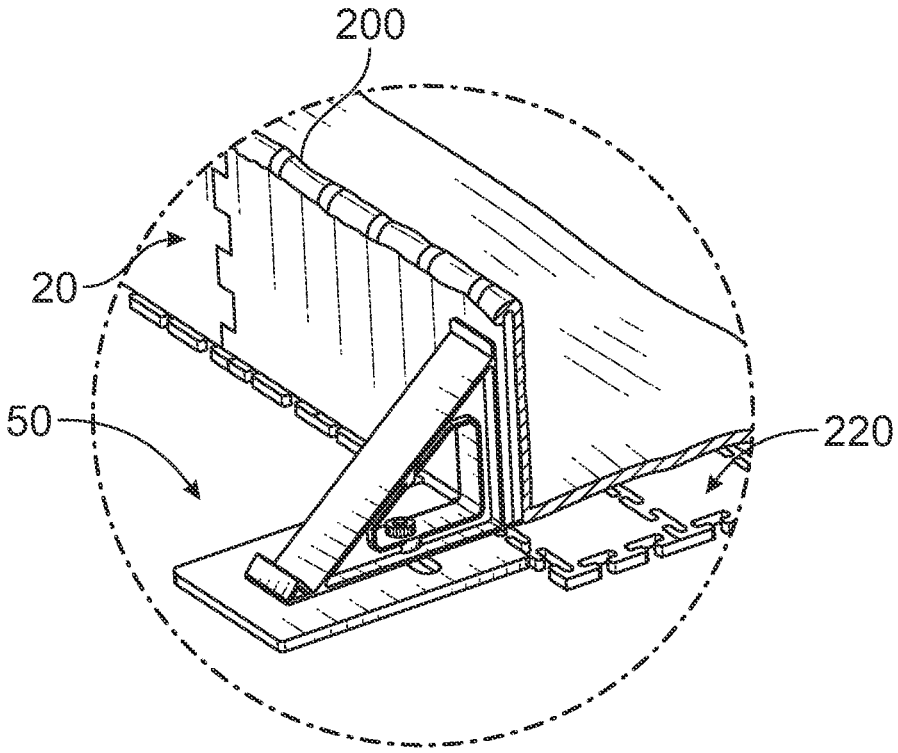
FIG. 14 is an alternate view of a portion of FIG. 1 showing a liner.

FIG. 14 is an alternate view of a portion of FIG. 1 showing a liner 200, and the individual tile surfaces 220 forming the bottom of the ice skating rink, the support 50, and the perimeter component 20.

Since the interlocking third member 230, either being represented by the first shape 240 or the second shape 250, is disposed at each edge of the tile 220, such interlocking third member 230 will be accessible from the peripheral edge of the grid of tiles 220. Thus, the modular structure 10 can comprise an interlocking third member 260 between a support 50 and a selective tile 220. Such interlocking third member 260 between the support 50 and the selective tile 220 can be any of the above described examples of interlocking third member 230 between two adjacent tiles 220. Such interlocking third member 260 will prevent unintended separation of the second member 90 and, therefore, will prevent unintended separation of the support 50 and subsequently an unintended outward shift of the side panel 30.

When the support 50 comprises separate first member 60 and second member 90, the interlocking third member 260 will be between the second member 90 and the selective tile 220, as the second member 90 will be positioned planar with the grid of tiles 220. When the support 50 is provided as a unitary member, the interlocking third member 260 will be between the second portion of the first member 70 and the selective tile 220.

Although, the, the second shape 250 have been illustrated as protruding past the exterior surface 32 of the side panel 30, such second shape 250 can be disposed under the thickness of the side panel 30 or even disposed inwardly from the inner surface 34.

Furthermore, when the structure 10 comprises a grid of tiles 220, the above described flange of second portion 80 abuts a portion of the surface 222, thus applying a force onto the respective tile 220 due to the weight of the support 50 and, more particularly, due to the weight of the side panel 30 received within the support 50.

The structure 10 of any of the above described embodiments can be described as a self-locking structure in that the support 50 interlocks with the tile 220 and the side panel 30 interlocks with the support 50 and applies downward force onto the tile 220.

It will be further understood from the above described embodiments that the support 50 can be referred to as free-standing structure support or a modular structure support.

A method of supporting a side wall of a modular structure, where the side wall comprising a plurality of side panels arranged, during use of the modular structure, in a generally vertical plane and in a closed configuration, can comprise steps of positioning second members in a generally horizontal plane external to the side wall and in a spaced apart relationship with each other around a perimeter of the side wall; inserting a portion of at least some of the plurality of side panels into a panel receiving portion of a first member; resting each first member on a respective second member; and fastening the each first member to the each respective second member. Term "resting" can also include term "supporting".

A method of supporting portable, self-standing ice skating rink structure can comprise the steps of positioning second members in a generally horizontal plane external to the perimeter component and in a spaced apart relationship with each other around the perimeter component; inserting portions of the perimeter component into a perimeter component receiving portion in each first member; resting the each first member on a respective second member; and fastening the each first member to the each respective second member.

A method of constructing an ice skating rink can comprise the steps of providing a plurality of boards; providing a plurality of first members, each of the first members comprising a receptacle for holding boards and a first aperture through a base portion of the each first member; providing a plurality of second members, each of the plurality of second members comprising a second aperture through a thickness of the each second member; fastening, with two threaded fasteners, the each first member to the each second member, wherein one from the two threaded fasteners is passed through the first and second aperture, so the ice skating rink is constructed without use of straps and without use of ground engaging projections; placing at least one board within the receptacle in the each first member to form a perimeter in the shape of an ice skating rink, where the second members and the first members are disposed external to the perimeter; placing a water impermeable liner within the perimeter; filling the perimeter with water; and allowing the water to freeze within the perimeter component. The method can further comprise the step of fastening the boards at their exterior vertical surfaces to the first members.

A method of constructing an ice skating rink can comprise the steps of providing a plurality of boards, the plurality of boards are being positioned in a vertical plane to define a perimeter component, positioning a plurality of tiles in a grid pattern; providing a plurality of first members, each of the first members comprising a receptacle for holding boards and a first aperture through a base portion of the each first member; providing a plurality of second members, each of the plurality of second members comprising a second aperture through a thickness of the each second member; fastening, with two threaded fasteners, each first member to the each second member, wherein one from the two threaded fasteners is passed through the first and second aperture, so that the ice skating rink is constructed without use of straps and without use of ground engaging projections; and placing at least one board within the receptacle in the each first member to form a perimeter in the shape of an ice skating rink, where the second members and the first members are disposed external to the perimeter.

Now in a reference to FIG. 14, therein is illustrated a panel. The panel can be used for use in erecting a modular perimeter component of a structure. The panel comprises a first surface of the panel and a second surface of the panel, the second surface being disposed at a distance from the first surface to define a thickness of the panel. The panels also comprises a first edge and a second edge, the second edge being disposed at a distance from the first edge to define a length of the panel. The panels also comprises a third edge and a fourth edge, the fourth edge being disposed at a distance from the third edge to define a width of the panel. The panels also comprises a flange. The flange extends outwardly from one of the first and second surfaces. The flange comprises a distal end, a first flange surface and a second flange surface. The second flange surface being disposed at a distance from the first flange surface to define a thickness of the flange. The panels can comprises an aperture formed through the thickness of the flange. The panel can also comprise a projection extending outwardly from the surface. During use, the aperture is used to fasten the flange to the above described second member 90. Likewise, the projection is used to interlock the flange with the second member 90 in a fastener-free manner.

In the exemplary embodiments, the first member 60 is molded from plastic materials. It is to be understood, however, that first member 60 may be constructed of any rigid material, including aluminum, steel, fiberglass or other material without departing from the novel scope of the present invention. Further, in the illustrative embodiment, anti-deterioration additives, such as ultra-violet stabilizers for plastic first members and galvanizing or other anti-corrosive agents on metal first members are used on first member 60. Likewise, the second member 90 can be constructed from any rigid material above. When the first member 60 and the second member 90 are provided as an integrated one-piece construction, the entire support 50 can be manufactured from above described materials.

As has been described above, the first member 60 can be referred to as a retaining buttress. Such retaining buttress can comprise at least one slab side, at least one brace side, at least one face side, and at least one retaining stem receiver; the at least one slab side including a heel end, a toe end, and at least one anchoring third member between the heel end and the toe end; the at least one brace side is at a first angle to the at least one slab side and the at least one brace side meets at the toe end of the at least one slab side, the first angle being less than ninety (90) degrees; the at least one face side is at a second angle to the at least one brace side, the at least one face side is of a substantially perpendicular angle to the at least one slab side, and the at least one face side is oriented to the heel end of the at least one slab side; and the at least one retaining stem receiver is on the heel end of the at least one slab side, and adjacent to the at least one face side. The at least one anchoring third member can be an only one anchoring third member. The only one anchoring third member can extend vertically through the brace side of the retaining buttress. The only one anchoring third member can only extend through the slab side and the retaining buttress can comprise a hollow interior.

As has been described above, the second member 90 can be referred to as a retaining anchor plate. Such retaining anchor plate can comprise at least one ground side, at least one buttress slab side, a toe end, a heel end, at least one anchoring recess, at least one anchor bolt, and at least one surface connecting third member; the at least one ground side being adjacent to and flush with a plane of reference, and the at least one ground side being opposite to the at least one buttress slab side; the at least one buttress slab side being oriented away from the plane of reference; the at least one anchoring recess being between the toe end and the heel end, and allowing the at least one anchor bolt to not protrude from the at least one ground side into the plane of reference; the at least one anchor bolt being oriented through the at least one anchoring recess and substantially perpendicular to the plane of reference; and the at least one surface connecting third member being oriented on the toe end of the at least one buttress slab side. The at least one surface connecting third member can include a shelf on either the at least one ground side or the at least one buttress slab side. The shelf can be disposed on the ground side of the retaining anchor plate. The at least one anchoring recess can comprise a slot that is disposed parallel relative to the at least one surface connecting third member. The at least one anchoring recess can be limited to a lip around the parallel slot and the at least one anchor bolt can be rounded. The at least one surface connecting third member can comprise a shelf on the at least one ground side.

The buttressed retaining wall system comprises at least one retaining buttress, at least one retaining anchor plate, and at least one retaining stem; the at least one retaining buttress including at least one slab side, at least one brace side, at least one face side, and at least one retaining stem receiver; the at least one slab side including a heel end, a toe end, and at least one anchoring third member between the heel end and the toe end; the at least one brace side is of an adjacent angle to the at least one slab side and the at least one brace side meets at the toe end of the at least one slab; the at least one face side is of an opposite angle to the at least one brace side, the at least one face side is of a substantially perpendicular angle to the at least one slab side, and the at least one face side is oriented to the heel end of the at least one slab side; and the at least one retaining stem receiver is on the heel end of the at least one slab side, and adjacent to the at least one face side; the at least one retaining anchor plate including at least one ground side, at least one buttress slab side, a toe end, a heel end, at least one anchoring recess, at least one anchor bolt, and at least one surface connecting third member; the at least one ground side being adjacent to and flush with a plane of reference, and the at least one ground side being opposite to the at least one buttress slab side; the at least one buttress slab side being oriented away from the plane of reference; the at least one anchoring recess being between the toe end and the heel end, and allowing the at least one anchor bolt to not protrude from the at least one ground side into the plane of reference; the at least one anchor bolt being oriented through the at least one anchoring recess and substantially perpendicular to the plane of reference; and the at least one surface connecting third member being oriented on the toe end of the buttress slab side; and the at least one retaining stem including at least one lateral force face, at least one buttress face, and at least one receiving mate; the at least one retaining stem receiver on the heel end of the retaining buttress accommodates the retaining stem at the receiving mate, and the at least one lateral force face is facing away from the at least one retaining buttress while the at least one buttress face is facing towards the at least one retaining buttress; the at least one slab side of the at least one retaining buttress and at least one buttress slab side of the at least one anchor plate are oriented to face and be adjacent to each other; the at least one anchoring recess of the anchor plate aligns with the at least one anchoring third member between the heel end and the toe end of the at least one slab side of the at least one retaining buttress, and the at least one anchor bolt secures the at least one retaining buttress to the at least one anchor plate; and the at least one surface connecting third member on the toe end of the buttress slab side of the at least one anchor plate is attached to at least one surface plate. The at least one anchoring recess includes a parallel slot relative to the at least one surface connecting third member, the at least one anchoring recess is being limited to a lip around the parallel slot and the at least one anchor bolt is rounded, and the at least one surface connecting third member includes a shelf on the at least one ground side.

In an embodiment, therein is provided a self-standing modular structure support for a self-standing structure comprising a perimeter component, the self-standing structure support comprising a first member, the first member comprising a perimeter component receiving portion; a second member, being disposed, during use of the self-standing modular structure, in a generally horizontal plane, the second member extending, during the use, outwardly from an exterior surface of the perimeter component; and a third member, the third member being configured to detachably connect the first member to the second member; the first member being supported, during the use, on the second member; the support being configured to support the perimeter component without use of straps and without use of ground engaging projections when the perimeter component is received within a perimeter component receiving portion of the first member.

A feature of this embodiment is that the third member comprises a first aperture, the first aperture extending through the reduced thickness portion of the second member; a second aperture, the second aperture extending through a thickness portion in the first member; a first fastener, the first fastener comprising a first portion and a second portion, the first portion being sized larger than the first aperture, the second portion being sized to pass through the first and second apertures, the second portion comprising an external thread, the external thread protruding, during the use, past the thickness of the first member; and a second fastener, the second fastener comprising an internal thread, the internal thread being complimentary to the external thread so that second fastener can threadably engage the external thread so as to detachably fasten the first member to the second member.

A feature of this embodiment is that the third member comprises a cavity in a thickness of the second member, the thickness defined by a space between opposite surfaces of the second member, the cavity defining a reduced thickness portion of the second member; a first aperture, the first aperture extending through the reduced thickness portion of the second member, a size of the first aperture being smaller than a size of the cavity; a second aperture, the second aperture extending through a thickness portion in the first member; a first fastener, the first fastener comprising a first portion and a second portion, the first portion being sized and shaped to be received within the cavity, the second portion being sized to pass through the first and second apertures, the second portion comprising an external thread, the external thread protruding, during the use, past a thickness of the first member, the first portion being sized larger than the second portion; and a second fastener, the second fastener comprising a thread, the thread being complimentary to the external thread so that second fastener can threadably engage the external thread so as to detachably fasten the first member to the second member.

A feature of this embodiment is that each of the cavity and the first aperture defines an elongated shape, the elongated shape comprises a length being greater than a width, the length disposed generally parallel to the exterior surface during use of the modular structure.

A feature of this embodiment is that the first member comprises a J-shaped first portion; a base extending outwardly from and generally perpendicular to the J-shaped first portion, the base comprising a first surface and a second surface, the second surface being disposed at a distance from the first surface to define a thickness of the base, the base being disposed, during use, in a contact with the second member; and an aperture disposed though the thickness.

A feature of this embodiment is that the first member comprises a J-shaped first portion; a base extending from the J-shaped first portion, the base comprising a first surface and a second surface, the second surface being disposed at a distance from the first surface to define a thickness of the base, the base being disposed, during use, in a contact with the second member; a brace coupling the J-shaped support to the base, the brace being disposed at an acute angle to each of the J-shaped first portion and the base, the brace defining a hollow interior of the first member; and an aperture disposed though the thickness of the base in an open communication with the hollow interior.

A feature of this embodiment is that the first member comprises a J-shaped first portion; a base extending from the J-shaped first portion, the base comprising a first surface and a second surface, the second surface being disposed at a distance from the first surface to define a thickness of the base, the base being disposed, during use, in a contact with the second member; a flange extending from the J-shaped first portion in a direction opposite to a direction of the base; a brace coupling the J-shaped support to the base, the brace being disposed at an acute angle to each of the J-shaped first portion and the base, the brace defining a hollow interior of the first member; and an aperture disposed though the thickness of the base in an open communication with the hollow interior.

In an embodiment, a modular structure, comprises a perimeter component, the perimeter component being disposed, during use of the modular structure, in a generally vertical plane, the perimeter component defining a peripheral side wall of the modular structure, the peripheral side wall comprising an exterior surface; and supports, the supports being disposed, during use, at a distance from each other about the exterior surface, the supports configured to support the perimeter component in the generally vertical plane without use of straps and without use of ground engaging projections when a portion of the perimeter component is received within a perimeter receiving portion of each support.

A feature of this embodiment is that a plurality of tiles being disposed, during the use, in a grid pattern and in a generally horizontal plane; and an interlocking connection between opposing edges of two adjacent tiles; the perimeter component surrounding the grid pattern of the tiles.

A feature of this embodiment is that the modular structure further comprises an interlocking connection between each support and a selective tile from the plurality of tiles.

A feature of this embodiment is that each support comprises a flange, the flange extending from the perimeter receiving portion to be positioned, during use of the modular structure, over a selective tile.

A feature of this embodiment is that the interlocking connection comprises a first shape in a first tile from the two adjacent tiles and second shape in a second tile from the two adjacent tiles, the second shape being sized to be received within the first shape so that the two adjacent tiles are prevented from an unintentional separation in the generally horizontal plane during use of the modular structure.

A feature of this embodiment is that the first shape comprises a first portion and a second portion, the first portion of the first shape being disposed at a distance inwardly from an edge of the first panel and the second portion of the first shape being in an open communication with the edge of the first panel and the first portion of the first shape, the first portion of the first shape being wider than the second portion of the first shape.

A feature of this embodiment is that the second shape comprises a first portion and a second portion, the first portion of the second shape being disposed at the distance outwardly from an edge of the first tile and the second portion of the second shape bridging the distance between the first portion of the second shape and the edge, the first portion of the second shape being sized to be received within the first portion of the first shape and the second portion of the second shape being sized to be received within the second portion of the first shape.

A feature of this embodiment is that the first shape comprises a cavity in the first tile, the cavity being in an open communication with an edge of the first tile and a second shape, the second shape extending from an edge of the second tile, the second shape being sized to be received within the first shape.

A feature of this embodiment is that each tile from the plurality of tiles comprises a surface configured to be skated thereon.

A feature of this embodiment is that the modular structure further comprises a water impermeable liner, the water impermeable liner being laid within an interior of the perimeter component.

A feature of this embodiment is that each support comprises a first member, the first member comprising the side perimeter receiving portion; a second member, the second member extending, during the use, outwardly from the exterior surface; and a third member detachably connecting the first member to the second member; the first member being supported, during the use, on the second member.

A feature of this embodiment is that the perimeter component comprises a plurality of panels, the plurality of panels being arranged, during use of the modular structure, in the generally vertical plane.

A feature of this embodiment is that each support comprises a first member, the first member comprising a perimeter component receiving portion; a second member, being disposed, during use of the self-standing modular structure, in a generally horizontal plane, the second member extending, during the use, outwardly from an exterior surface of the perimeter component; and a third member, the third member being configured to detachably connect the first member to the second member; the first member being supported, during the use, on the second member; the support being configured to support the perimeter component without use of straps and without use of ground engaging projections when the perimeter component is received within a perimeter component receiving portion of the first member.

A feature of this embodiment is that the third member comprises an aperture, the aperture extending through a thickness portion in the first member; a projection upstanding on a surface of the second member, the projection being sized and shaped to pass through the aperture, the projection comprising an external thread, the external thread protruding past a thickness of the first member; and a fastener, the fastener comprising an internal thread, the internal thread being complimentary to the external thread so that the fastener can threadably engage the external thread so as to detachably fasten the first member to the second member.

A feature of this embodiment is that the third member comprises a threaded aperture in a thickness of the second member, the thickness defined by a space between opposite surfaces of the second member; an aperture, the aperture extending through a thickness in the first member; a fastener, the fastener comprising a first portion and a second portion, the first portion being sized larger than the aperture, the second portion being sized and shaped to pass through the aperture, the second portion comprising an external thread, the external thread threadably engages the threaded aperture in the second member so as to detachably fasten the first member to the second member.

A feature of this embodiment is that the third member comprises a threaded aperture in a thickness of the first member; an aperture, the aperture extending through a thickness in the second member, the thickness defined by a space between opposite surfaces of the second member; a fastener, the fastener comprising a first portion and a second portion, the first portion being sized larger than the aperture, the second portion being sized and shaped to pass through the aperture, the second portion comprising an external thread, the external thread threadably engages the threaded aperture in the first member so as to detachably fasten the first member to the second member.

A feature of this embodiment is that the third member comprises a cavity in a thickness of the second member, the thickness defined by a space between opposite surfaces of the second member, the cavity defining a reduced thickness portion of the second member; an aperture, the aperture extending through the reduced thickness portion of the second member, a size of the aperture being smaller than a size of the cavity; a projection upstanding on a surface of the first member, the projection being sized and shaped to pass through the aperture, the projection comprising an external thread, the external thread protruding past the reduced thickness of the second member into the cavity; and a fastener, the fastener comprising a thread, the thread being complimentary to the external thread so that the fastener can threadably engage the external thread so as to detachably fasten the first member to the second member.

A feature of this embodiment is that the each of the first shape and the second shape comprises tapered edges.

A feature of this embodiment is that the each of the first shape and the second shape is partially round.

In an embodiment, a modular playing arena, comprises a playing structure comprising a plurality of modular tiles disposed, during use, in a generally horizontal plane, the plurality of tiles defining a closed polygonal configuration; an interlocking connection between opposing edges of two adjacent tiles; a plurality of side panels, the plurality of side panels arranged, during the use, in a generally vertical plane and in a closed polygonal configuration surrounding and abutting the polygonal arrangement of the plurality of tiles, the plurality of side panels defining a peripheral side wall of the modular playing arena, the peripheral side wall comprising an exterior surface; a plurality of first members, each first member comprising a side panel receiving portion; a plurality of second members, the plurality of second members being disposed, during the use, in a generally horizontal plane and at a distance from each other about the peripheral side wall surface, each second member from the plurality of second members extending, during the use, outwardly from the exterior surface; and a plurality of third members, each third member from the plurality of third members being configured to detachably connect each first member to a respective second member; the each first member being supported, during the use, on a respective second member from the plurality of second members; the plurality of first members and the plurality of second members being configured, through the third member, to support the side panels in the generally vertical plane without use of straps and without use of ground engaging projections.

A feature of this embodiment is that the modular playing arena further comprising an interlocking connection between each second member and a selective tile.

A feature of this embodiment is that the interlocking connection between each second member and the selective tile is the interlocking connection between the two adjacent tiles.

A feature of this embodiment is that each second member further comprises a flange, the flange extending outwardly from the second member, during the use of the modular structure, to be disposed under a surface of the respective tile.

A feature of this embodiment is that each first member further comprises a flange, the flange extending outwardly from the side panel receiving portion, during the use of the modular structure, to be disposed over a surface of the respective tile.

In an embodiment, a modular playing arena comprises a floor structure disposed, during use, in a generally horizontal plane; a plurality of side panels, the plurality of side panels arranged, during the use, in a generally vertical plane and in a closed configuration surrounding and abutting the floor structure, the plurality of side panels defining a peripheral side wall of the modular playing arena, the peripheral side wall comprising an exterior surface; a plurality of first members, each first member comprising a side panel receiving portion; a plurality of second members, the plurality of second members being disposed, during the use, in a generally horizontal plane and at a distance from each other about the peripheral side wall surface, each second member from the plurality of second members extending, during the use, outwardly from the exterior surface; and a plurality of third members, each third member from the plurality of third members being configured to detachably connect each first member to a respective second member; the each first member being supported, during the use, on a respective second member from the plurality of second members; the plurality of first members and the plurality of second members being configured, through the third member, to support the side panels in the generally vertical plane without use of straps and without use of ground engaging projections.

A feature of this embodiment is that the modular playing arena can further comprise a sealing means forming a fluid tight seal between the floor structure and at the juncture of the floor structure and the side panels.

A feature of this embodiment is that the floor structure comprises a plurality of modular tiles and an interlocking connection between two adjacent tiles.

In an embodiment, a portable, self-standing ice skating rink structure comprises a perimeter component, comprising; first members; second members disposed external to the perimeter component; and a water-impermeable liner disposed within the perimeter component; each first member being detachably attached to a respective second member; the first members and the second members configured to support the perimeter component without use of straps and without use of ground engaging projections when the perimeter component is received within a perimeter component receiving portion in each first member.

A feature of this embodiment is that the perimeter component comprises a plurality of interlocking side boards.

In an embodiment, a self-standing structure support is provided for the self-standing structure that comprises a side wall, the side wall comprising a plurality of side panels arranged, during use, in a generally vertical plane and in a closed peripheral configuration, the side wall defining an exterior surface, the support comprises a first member, the first member comprising a side panel receiving portion; a second member, being disposed, during the use, in a generally horizontal plane the second member extending, during the use, outwardly from the exterior surface; and a third member between the first member and the second member; the first member being supported, during the use, on the second member; the support being configured to support a respective side panel in the generally vertical plane without use of straps and without use of ground engaging projections when a side panel is received within the panel receiving portion.

In an embodiment, a bracket consists only of a J-shaped first portion; a base extending outwardly from and generally perpendicular to the J-shaped first portion, the base comprising a first surface and a second surface, the second surface being disposed at a distance from the first surface to define a thickness of the base member; and an aperture disposed though the thickness.

In an embodiment, a bracket consists only of a J-shaped first portion; a base extending from the J-shaped first portion, the base comprising a first surface and a second surface, the second surface being disposed at a distance from the first surface to define a thickness of the base; a brace coupling the J-shaped support to the base, the brace being disposed at an acute angle to each of the J-shaped first portion and the base, the brace defining a hollow interior of the first member; and an aperture disposed though the thickness of the base in an open communication with the hollow interior.

In an embodiment, a bracket consists only of a J-shaped first portion; a base extending from the J-shaped first portion, the base comprising a first surface and a second surface, the second surface being disposed at a distance from the first surface to define a thickness of the base; a flange extending from the J-shaped first portion in a direction opposite to a direction of the base; a brace coupling the J-shaped support to the base, the brace being disposed at an acute angle to each of the J-shaped first portion and the base, the brace defining a hollow interior of the first member; and an aperture disposed though the thickness of the base in an open communication with the hollow interior.

In an embodiment, a method of supporting a side wall of a modular structure, the side wall comprising a plurality of side panels arranged, during use of the modular structure, in a generally vertical plane and in a closed configuration, the method comprises steps of positioning second members in a generally horizontal plane external to the side wall and in a spaced apart relationship with each other around a perimeter of the side wall; inserting a portion of at least some of the plurality of side panels into a panel receiving portion of a first member; resting each first member on a respective second member; and fastening the each first member to the each respective second member.

In an embodiment, a method of supporting portable, self-standing ice skating rink structure, the method comprises the steps of positioning second members in a generally horizontal plane external to the perimeter component and in a spaced apart relationship with each other around the perimeter component; inserting portions of the perimeter component into a perimeter component receiving portion in each first member; resting the each first member on a respective second member; and fastening each first member to the each respective second member.

In an embodiment, a method of constructing an ice skating rink, the method comprises the steps of providing a plurality of boards; providing a plurality of first members, each of the first members comprising a receptacle for holding boards and a first aperture through a base portion of the each first member; providing a plurality of second members, each of the plurality of second members comprising a second aperture through a thickness of each second member; fastening, with two threaded fasteners, the each first member to the each second member, wherein one from the two threaded fasteners is passed through the first and second aperture, so the ice skating rink is constructed without use of straps and without use of ground engaging projections; placing at least one board within the receptacle in each first member to form a perimeter in the shape of an ice skating rink, where the second members and the first members are disposed external to the perimeter; placing a water impermeable liner within the perimeter; filling the perimeter with water; and allowing the water to freeze within the perimeter.

A feature of this embodiment is that the method further comprises the step of releasably fastening the boards at their outer vertical sides to the first members:

A feature of this embodiment is that the method further comprises the step of releasably fastening the boards at their outer vertical sides to the first members.

In an embodiment, a method of constructing an ice skating rink, the method comprises the steps of providing a plurality of boards; providing a plurality of first members, each of the first members comprising a receptacle for holding boards and a first aperture through a base portion of the each first member; providing a plurality of second members, each of the plurality of second members comprising a second aperture through a thickness of each second member; fastening, with two threaded fasteners, each first member to each second member, wherein one from the two threaded fasteners is passed through the first and second aperture, so the ice skating rink is constructed without use of straps and without use of ground engaging projections; and placing at least one board within the receptacle in each first member to form a perimeter in the shape of an ice skating rink, where the second members and the first members are disposed external to the perimeter.

A feature of this embodiment is that the method further comprises the step of placing a water impermeable liner within the plurality of boards.

In an embodiment, a panel is provided for use in erecting a modular perimeter component of a structure, the panel comprises a first surface; a second surface, the second surface being disposed at a distance from the first surface to define a thickness of the panel; a first edge; a second edge; the second edge being disposed at a distance to the first edge to define a width of the panel; a third edge; a fourth edge, the fourth edge being disposed at a distance from the third edge to define a length of the panel; a flange, the flange extending outwardly from one of the first and second surfaces, the flanges comprising a distal end, a first flange surface and a second flange surface, the second flange surface being disposed at a distance from the first flange surface to define a thickness of the flange; and an aperture formed through the thickness of the flange.

A feature of this embodiment is that the panel further comprises a brace, the brace comprising one end thereof being in a rigid third member with the one of the first and second surfaces and another end thereof being in a rigid third member with the distal edge of the flange, the brace being disposed at an acute angle to the flange.

If the provisions of 35 USC § 112 6 are desired to be invoked in any apparatus claim associated herewith, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC § 112 are not intended to be invoked for that claim.

What is claimed is:

1. A self-standing modular structure support, the self-standing structure comprising a perimeter component and a floor surface, said self-standing structure support comprising:

a first member, said first member comprising a perimeter component receiving portion;

a second member, being disposed, during use of said self-standing modular structure, in a generally horizontal plane, said second member extending, during said use, outwardly from an exterior surface of said perimeter component and connecting to the floor surface; and a third member, said third member being configured to detachably connect said first member to said second member;

said first member being supported, during said use, on said second member;

said support being configured to support the perimeter component when the perimeter component is received within the perimeter component receiving portion of said first member, and the second member is connecting to the floor surface.

2. The self-standing modular structure support of claim 1, wherein said third member comprises:

a first aperture, said first aperture extending through said reduced thickness portion of said second member;

a second aperture, said second aperture extending through a thickness portion in said first member;

a first fastener, said first fastener comprising a first portion and a second portion, said first portion being sized larger than said first aperture, said second portion being sized to pass through said first and second apertures, said second portion comprising an external thread, said external thread protruding, during said use, past said thickness of said first member; and a second fastener, said second fastener comprising an internal thread, said internal thread being complimentary to said external thread so that second fastener can threadably engage said external thread so as to detachably fasten said first member to said second member.

3. The self-standing modular structure support of claim 1, wherein said third member comprises:

a cavity in a thickness of said second member, said thickness defined by a space between opposite surfaces of said second member, said cavity defining a reduced thickness portion of said second member;

a first aperture, said first aperture extending through said reduced thickness portion of said second member, a size of said first aperture being smaller than a size of said cavity;

a second aperture, said second aperture extending through a thickness portion in said first member;

a first fastener, said first fastener comprising a first portion and a second portion, said first portion being sized and shaped to be received within said cavity, said second portion being sized to pass through said first and second apertures, said second portion comprising an external thread, said external thread protruding, during said use, past a thickness of said first member, said first portion being sized larger than said second portion; and a second fastener, said second fastener comprising a thread, said thread being complimentary to said external thread so that second fastener can threadably engage said external thread so as to detachably fasten said first member to said second member.

4. The self-standing modular structure support of claim 3, wherein each of said cavity and said first aperture defines an elongated shape, said elongated shape comprises a length being greater than a width, said length disposed generally parallel to said exterior surface during use of said modular structure.

5. The self-standing modular structure support of claim 1, wherein said first member comprises:

a J-shaped first portion;

a base extending outwardly from and generally perpendicular to said J-shaped first portion, said base comprising a first surface and a second surface, said second surface being disposed at a distance from said first surface to define a thickness of said base, said base being disposed, during use, in a contact with said second member; and an aperture disposed though said thickness.

6. The self-standing modular structure support of claim 1, wherein said first member comprises:

a J-shaped first portion;

a base extending from said J-shaped first portion, said base comprising a first surface and a second surface, said second surface being disposed at a distance from said first surface to define a thickness of said base, said base being disposed, during use, in a contact with said second member;

a brace coupling said J-shaped support to said base, said brace being disposed at an acute angle to each of said J-shaped first portion and said base, said brace defining a hollow interior of said first member; and an aperture disposed though said thickness of said base in an open communication with said hollow interior.

7. The self-standing modular structure support of claim 1, wherein said first member comprises:

a J-shaped first portion;

a base extending from said J-shaped first portion, said base comprising a first surface and a second surface, said second surface being disposed at a distance from said first surface to define a thickness of said base, said base being disposed, during use, in a contact with said second member;

a flange extending from said J-shaped first portion in a direction opposite to a direction of said base;

a brace coupling said J-shaped support to said base, said brace being disposed at an acute angle to each of said J-shaped first portion and said base, said brace defining a hollow interior of said first member; and an aperture disposed though said thickness of said base in an open communication with said hollow interior.

8. The self-standing modular structure support of claim 1, wherein said third member comprises:

an aperture, said aperture extending through a thickness portion in said first member;

a projection upstanding on a surface of said second member, said projection being sized and shaped to pass through said aperture, said projection comprising an external thread, said external thread protruding past a thickness of said first member; and a fastener, said fastener comprising an internal thread, said internal thread being complimentary to said external thread so that said fastener can threadably engage said external thread so as to detachably fasten said first member to said second member.

9. The self-standing modular structure support of claim 1, wherein said third member comprises:

a threaded aperture in a thickness of said second member, said thickness defined by a space between opposite surfaces of said second member;

an aperture, said aperture extending through a thickness in said first member;

a fastener, said fastener comprising a first portion and a second portion, said first portion being sized larger than said aperture, said second portion being sized and shaped to pass through said aperture, said second portion comprising an external thread, said external thread threadably engages said threaded aperture in said second member so as to detachably fasten said first member to said second member.

10. The self-standing modular structure support of claim 1, wherein said third member comprises:

a threaded aperture in a thickness of said first member;

an aperture, said aperture extending through a thickness in said second member, said thickness defined by a space between opposite surfaces of said second member;

a fastener, said fastener comprising a first portion and a second portion, said first portion being sized larger than said aperture, said second portion being sized and shaped to pass through said aperture, said second portion comprising an external thread, said external thread threadably engages said threaded aperture in said first member so as to detachably fasten said first member to said second member.

11. The self-standing modular structure support of claim 1, wherein said third member comprises:

a cavity in a thickness of said second member, said thickness defined by a space between opposite surfaces of said second member, said cavity defining a reduced thickness portion of said second member;

an aperture, said aperture extending through said reduced thickness portion of said second member, a size of said aperture being smaller than a size of said cavity;

a projection upstanding on a surface of said first member, said projection being sized and shaped to pass through said aperture, said projection comprising an external thread, said external thread protruding past said reduced thickness of said second member into said cavity; and a fastener, said fastener comprising a thread, said thread being complimentary to said external thread so that said fastener can threadably engage said external thread so as to detachably fasten said first member to said second member.

12. A modular structure, comprising:

a perimeter component, said perimeter component being disposed, during use of said modular structure, in a generally vertical plane, said perimeter component defining a peripheral side wall of said modular structure, said peripheral side wall of a floor surface comprising an exterior surface; and supports, said supports being disposed, during use, at a distance from each other about said exterior surface, said supports configured to support said perimeter component in said generally vertical plane when a portion of said perimeter component is received within a perimeter receiving portion of each support and are connecting to the floor surface.

13. The modular structure of claim 12, further comprising:

The floor surface is a plurality of tiles disposed, during said use, in a grid pattern and in a generally horizontal plane; and an interlocking connection between opposing edges of two adjacent tiles;

said perimeter component surrounding said grid pattern of said tiles.

14. The modular structure of claim 13, further comprising an interlocking connection between said each support and a selective tile from said plurality of tiles.

15. The modular structure of claim 13, wherein said each support comprises a flange, said flange extending from said perimeter receiving portion to be positioned, during use of said modular structure, over a selective tile.

16. The modular playing arena of claim 13, wherein said interlocking connection comprises a first shape in a first tile from said two adjacent tiles and second shape in a second tile from said two adjacent tiles, said second shape being sized to be received within said first shape so that said two adjacent tiles are prevented from an unintentional separation in said generally horizontal plane during use of said modular structure.

17. The modular structure of claim 16, wherein said first shape comprises a first portion and a second portion, said first portion of said first shape being disposed at a distance inwardly from an edge of said first panel and said second portion of said first shape being in an open communication with said edge of said first panel and said first portion of said first shape, said first portion of said first shape being wider than said second portion of said first shape.

18. The modular structure of claim 16, wherein said second shape comprises a first portion and a second portion, said first portion of said second shape being disposed at said distance outwardly from an edge of said first tile and said second portion of said second shape bridging said distance between said first portion of said second shape and said edge, said first portion of said second shape being sized to be received within said first portion of said first shape and said second portion of said second shape being sized to be received within said second portion of said first shape.

19. The modular structure of claim 16, wherein said first shape comprises a cavity in said first tile, said cavity being in an open communication with an edge of said first tile and a second shape, said second shape extending from an edge of said second tile, said second shape being sized to be received within said first shape.

20. The modular structure of claim 16, wherein each of said first shape and said second shape comprises tapered edges.

21. The modular structure of claim 16, wherein each of said first shape and said second shape is partially round.

22. The modular structure of claim 12, wherein said each support comprises a first member, said first member comprising a perimeter component receiving portion;

a second member, being disposed, during use of said self-standing modular structure, in a generally horizontal plane, said second member extending, during said use, outwardly from an exterior surface of said perimeter component and connecting to a floor surface; and a third member, said third member being configured to detachably connect said first member to said second member;

said first member being supported, during said use, on said second member;

said support being configured to support the perimeter component when the perimeter component is received within a perimeter component receiving portion of said first member, and the second member is connecting to the floor surface.

* * * * *